US012259175B2

(12) United States Patent
Hong

(10) Patent No.: US 12,259,175 B2
(45) Date of Patent: Mar. 25, 2025

(54) REFRIGERATOR

(71) Applicant: LG Electronics Inc., Seoul (KR)

(72) Inventor: Euddeum Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 17/909,266

(22) PCT Filed: Mar. 10, 2020

(86) PCT No.: PCT/KR2020/003309
§ 371 (c)(1),
(2) Date: Sep. 2, 2022

(87) PCT Pub. No.: WO2021/182653
PCT Pub. Date: Sep. 16, 2021

(65) Prior Publication Data
US 2023/0087904 A1 Mar. 23, 2023

(51) Int. Cl.
*F25D 23/02* (2006.01)
*F25D 23/10* (2006.01)

(52) U.S. Cl.
CPC ..... *F25D 23/02* (2013.01); *F25D 23/10* (2013.01); *F25D 2201/126* (2013.01)

(58) Field of Classification Search
None
See application file for complete search history.

(56) References Cited

U.S. PATENT DOCUMENTS 2,816,331 A * 12/1957 Moore ..... F25D 23/082 52/784.15
6,138,432 A * 10/2000 Banicevic ..... F25D 23/02 312/405.1
8,230,647 B2 7/2012 Cho et al.
10,995,978 B2 * 5/2021 Lee ..... F25C 5/22
11,320,192 B2 * 5/2022 Lee ..... E06B 3/4627
11,402,147 B2 * 8/2022 Lee ..... F25D 23/02
(Continued)

FOREIGN PATENT DOCUMENTS

CN 207299701 5/2018
CN 209326184 8/2019
(Continued)

*Primary Examiner* — Hanh V Tran
(74) *Attorney, Agent, or Firm* — Fish & Richardson P.C.

(57) ABSTRACT

The present disclosure relates to a refrigerator capable of replacing an outer panel of a refrigerator. The refrigerator door includes: a frame assembly disposed in a line on both sides to form an edge of the refrigerator door, the frame assembly having a hollow portion formed in a longitudinal direction; a front panel coupled to one side of the frame assembly to form a front surface of the refrigerator door; and a rear panel coupled to the other side of the frame assembly to form a rear surface of the refrigerator door. The frame assembly has coupling holes communicating the hollow portion with an outside in one side facing the front panel, the coupling holes being spaced apart from each other in a vertical direction. A coupling protrusion, at least a portion of which passes through the coupling hole and is accommodated in the hollow portion of the frame assembly, is formed on a rear surface of the front panel.

28 Claims, 31 Drawing Sheets

(56) References Cited

U.S. PATENT DOCUMENTS

| | | | | |
|---|---|---|---|---|
| 2007/0188059 | A1* | 8/2007 | Davis | F24C 15/045 312/265.6 |
| 2008/0042537 | A1* | 2/2008 | Kim | F25D 23/02 312/405 |
| 2008/0120912 | A1* | 5/2008 | Crompton | F25D 23/028 49/372 |
| 2008/0143227 | A1* | 6/2008 | Kim | F25D 23/02 312/405 |
| 2012/0169196 | A1* | 7/2012 | Marchetti | E06B 5/006 312/265.6 |
| 2013/0050992 | A1* | 2/2013 | Schneider | G02B 6/0031 362/100 |
| 2013/0164483 | A1* | 6/2013 | Cites | B32B 3/04 428/68 |
| 2017/0318965 | A1* | 11/2017 | Hawkins | A47B 96/20 |
| 2019/0053685 | A1* | 2/2019 | Chwalibog | A47L 15/4293 |
| 2023/0012438 | A1* | 1/2023 | Hong | F25D 23/028 |
| 2023/0108392 | A1* | 4/2023 | Hong | F25D 23/085 312/405 |

FOREIGN PATENT DOCUMENTS

| | | | |
|---|---|---|---|
| CN | 209574617 | U * | 11/2019 |
| JP | 59013990 | | 1/1984 |
| JP | 07055328 | | 3/1995 |
| JP | 2016156556 | | 9/2016 |
| JP | 6460832 | | 1/2019 |
| KR | 20060120802 | | 11/2006 |
| KR | 100692223 | | 3/2007 |
| KR | 20120125626 | A * | 11/2012 |

* cited by examiner

【Fig. 1】
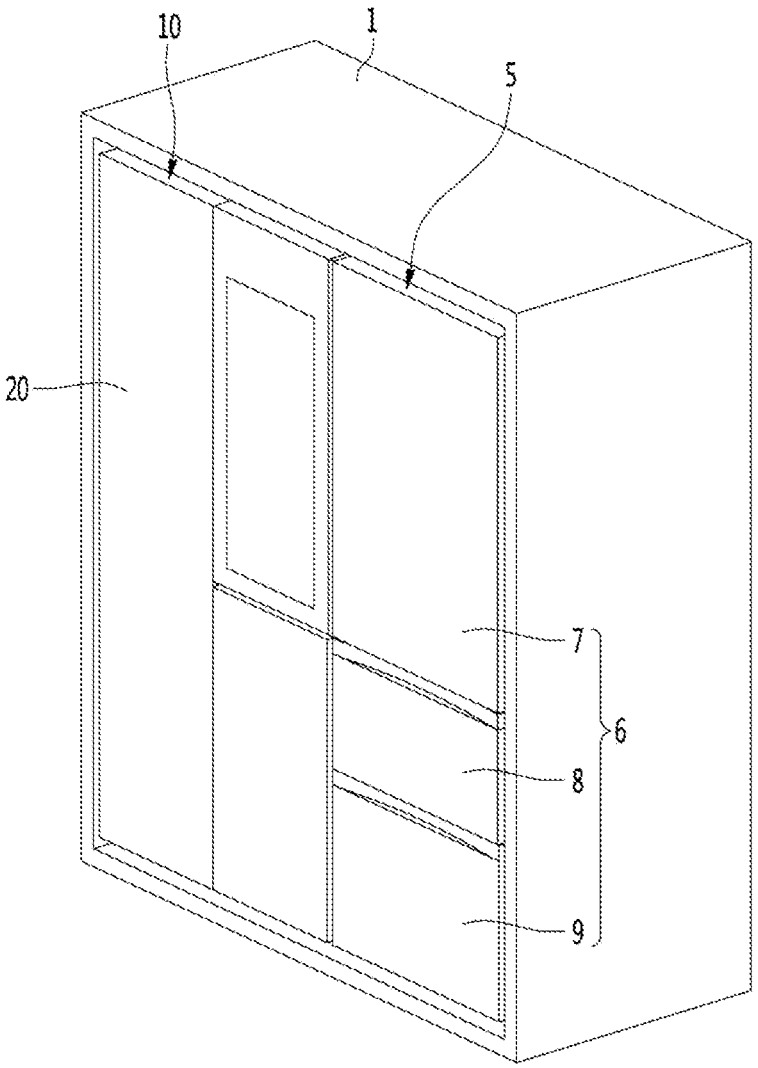

【Fig. 2】
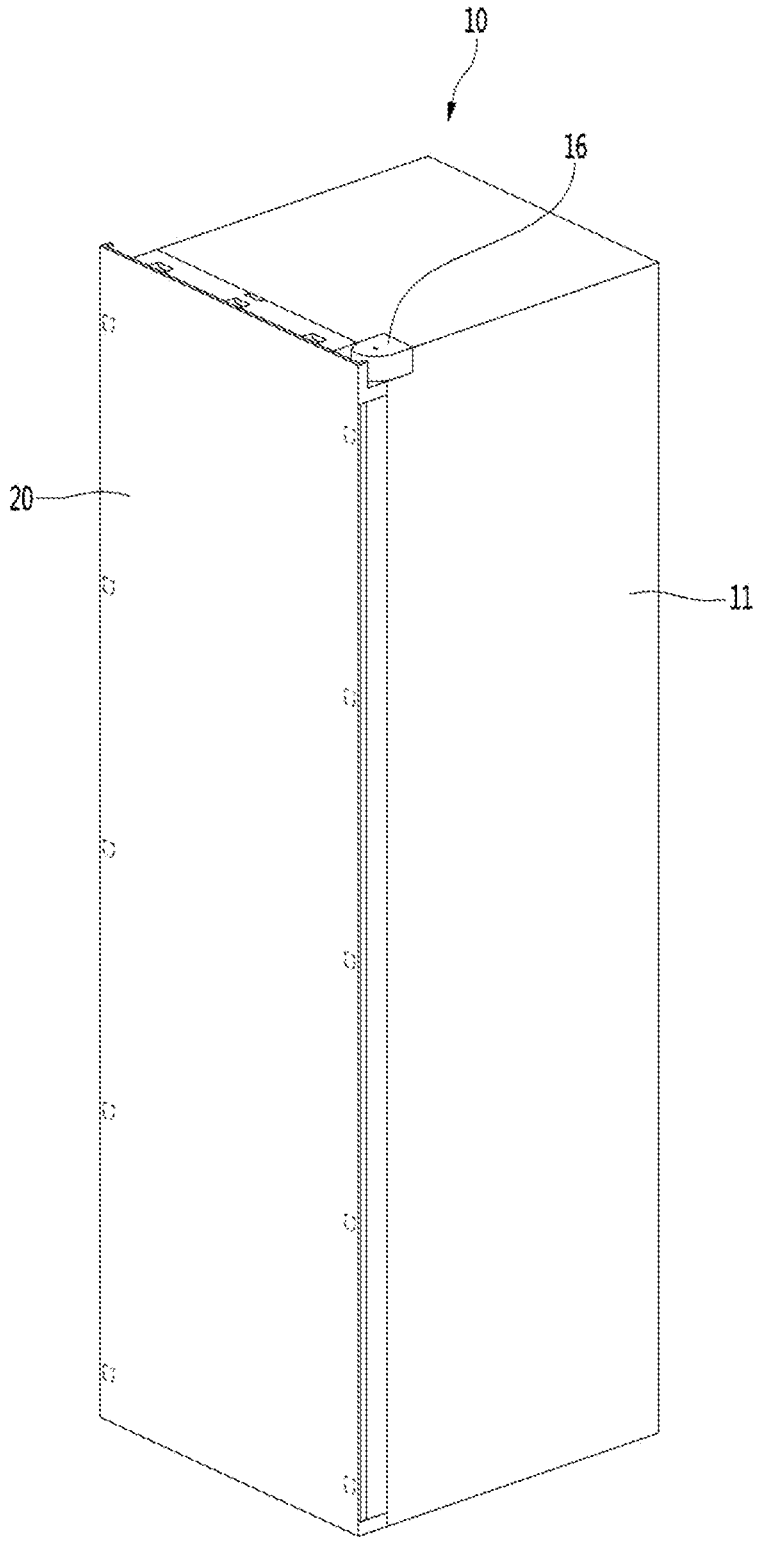

【Fig. 3】
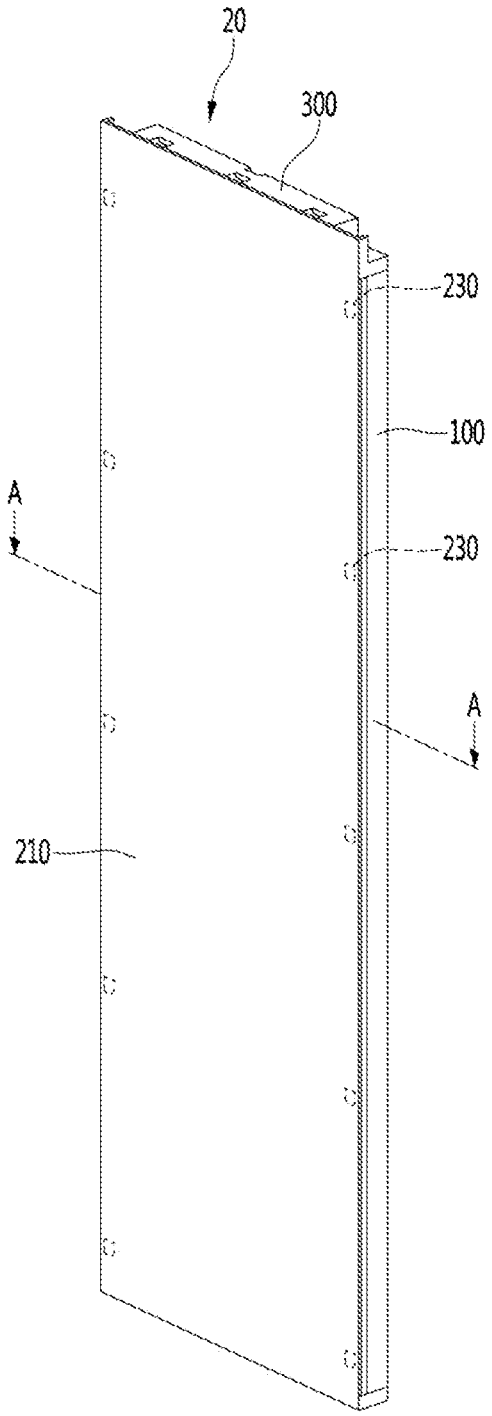

【Fig. 4】
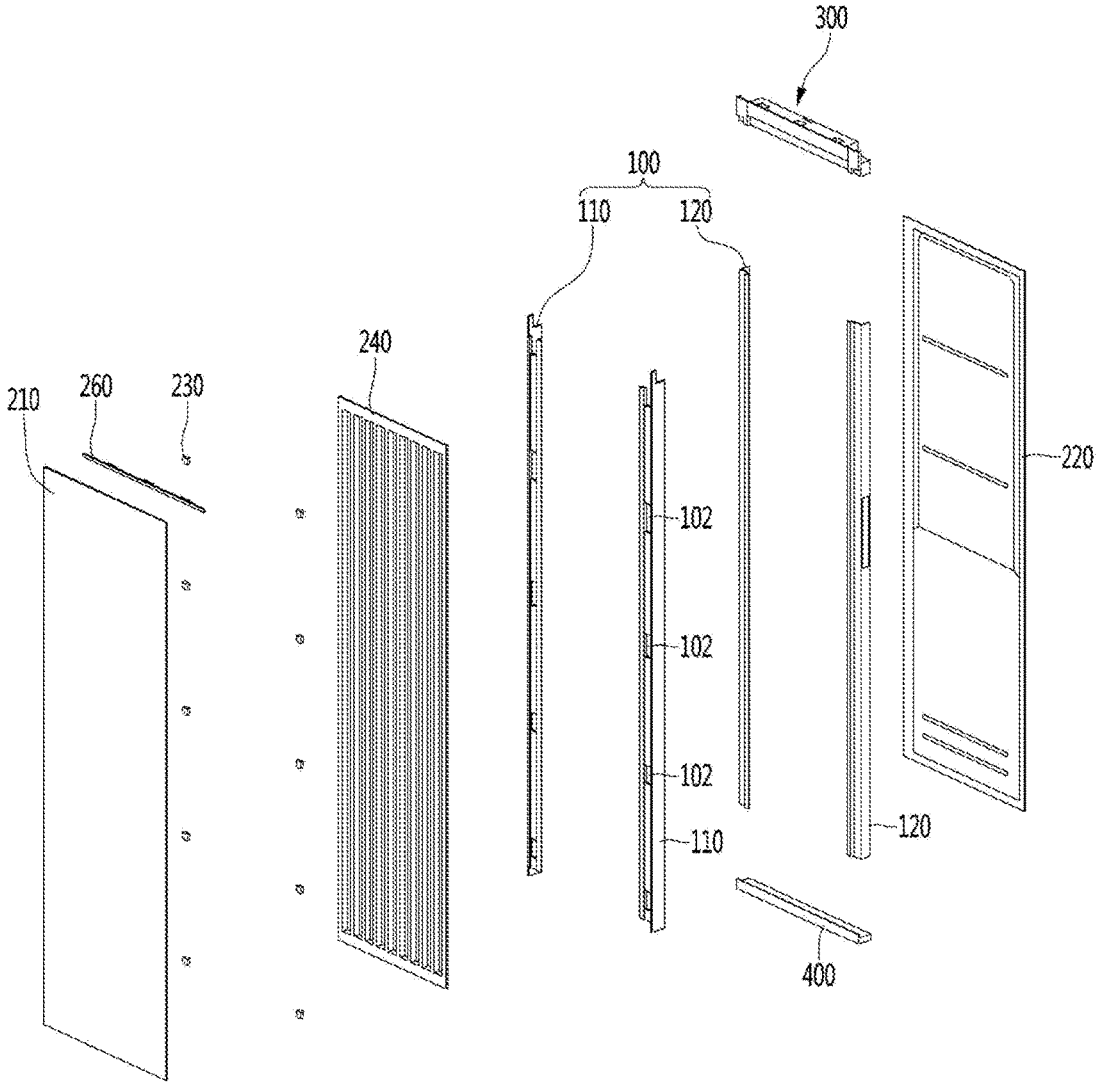

【Fig. 5】
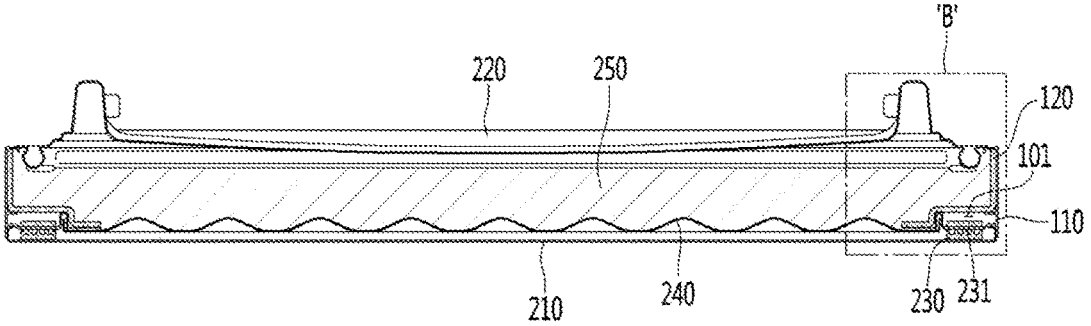

【Fig. 6】
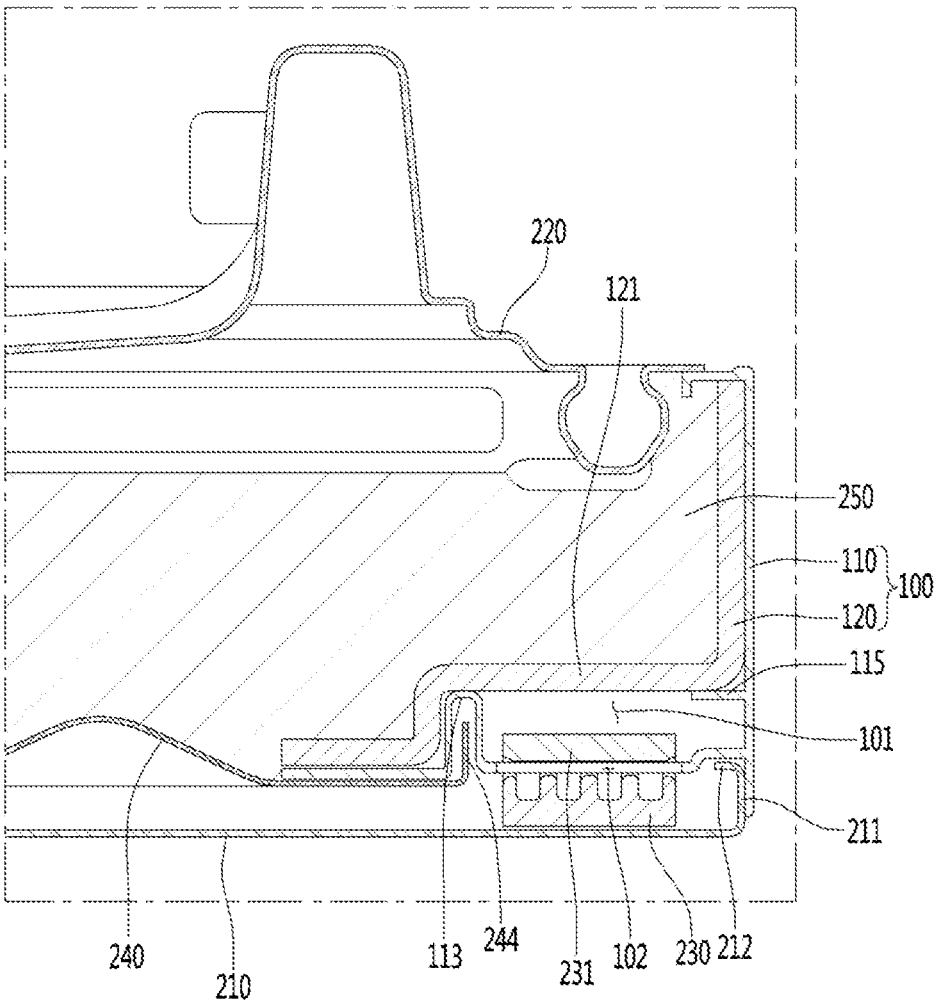

【Fig. 7】
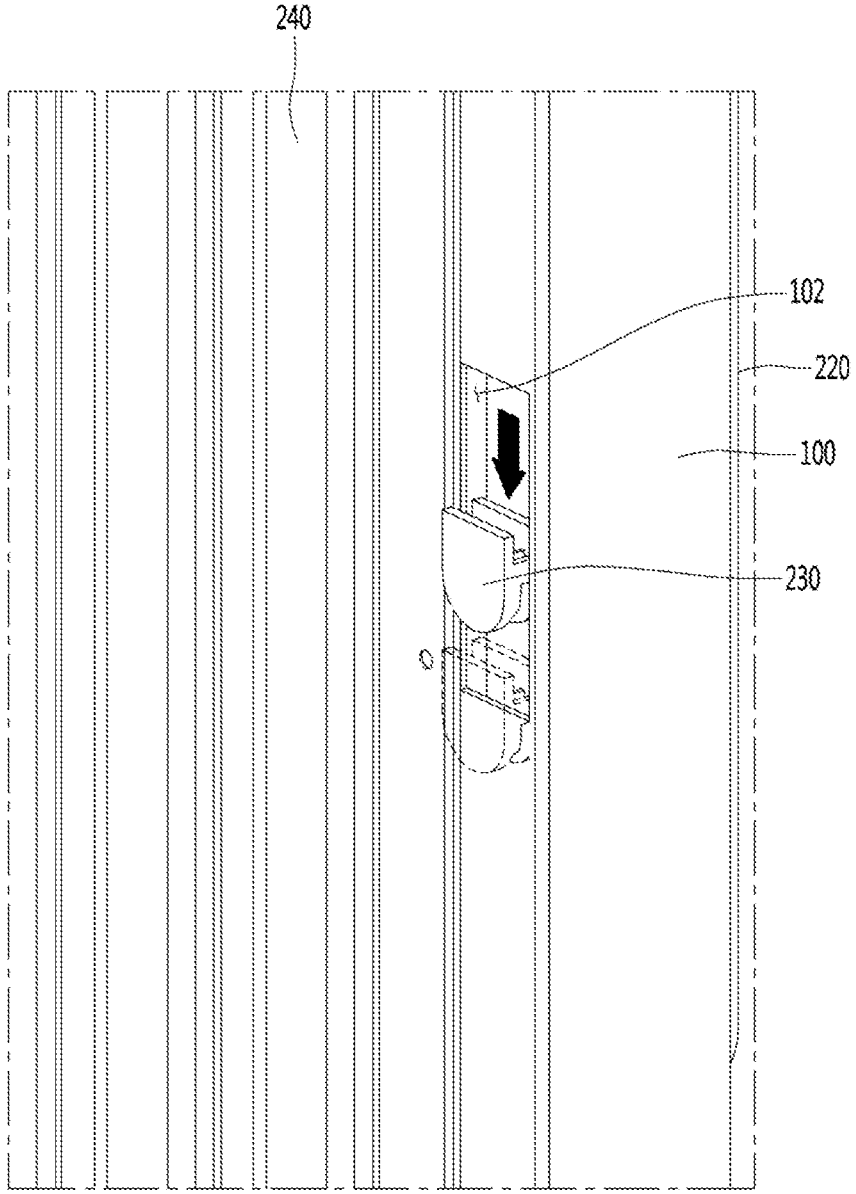

【Fig. 8】
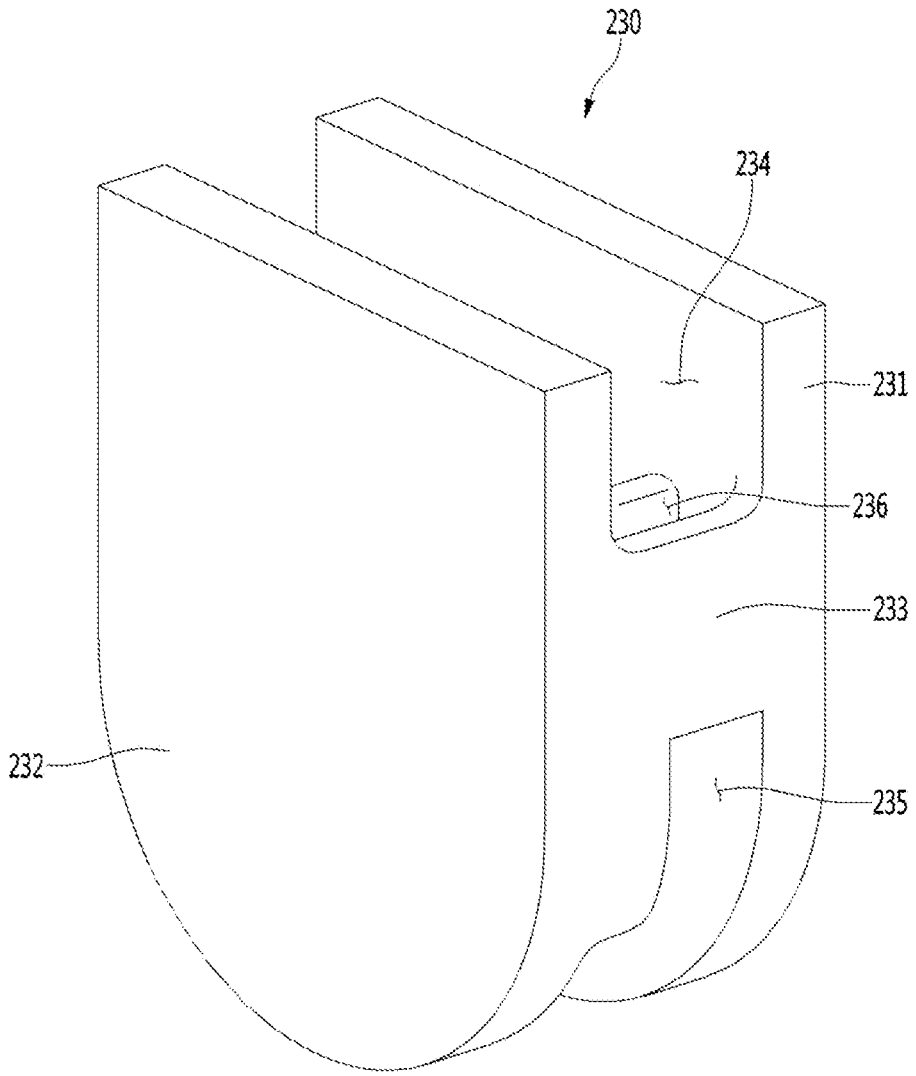

【Fig. 9】
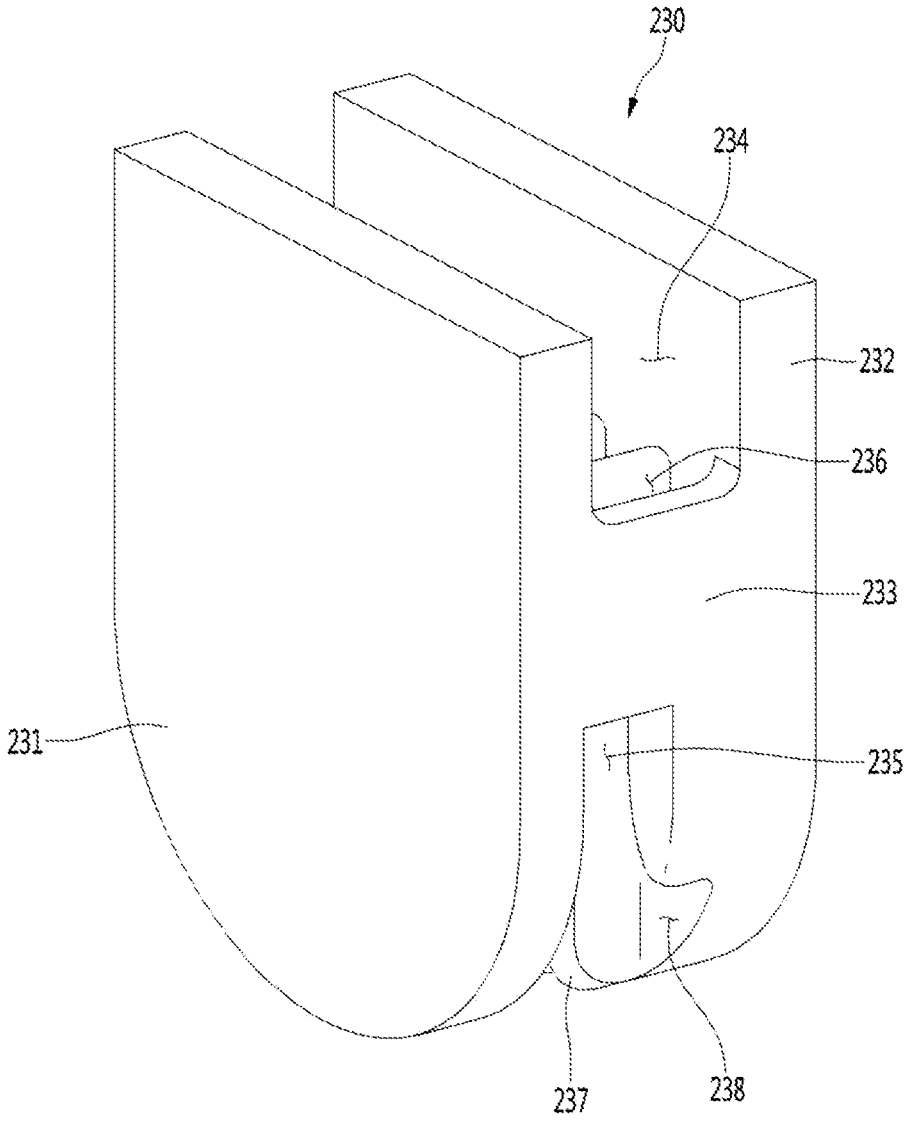

【Fig. 10】
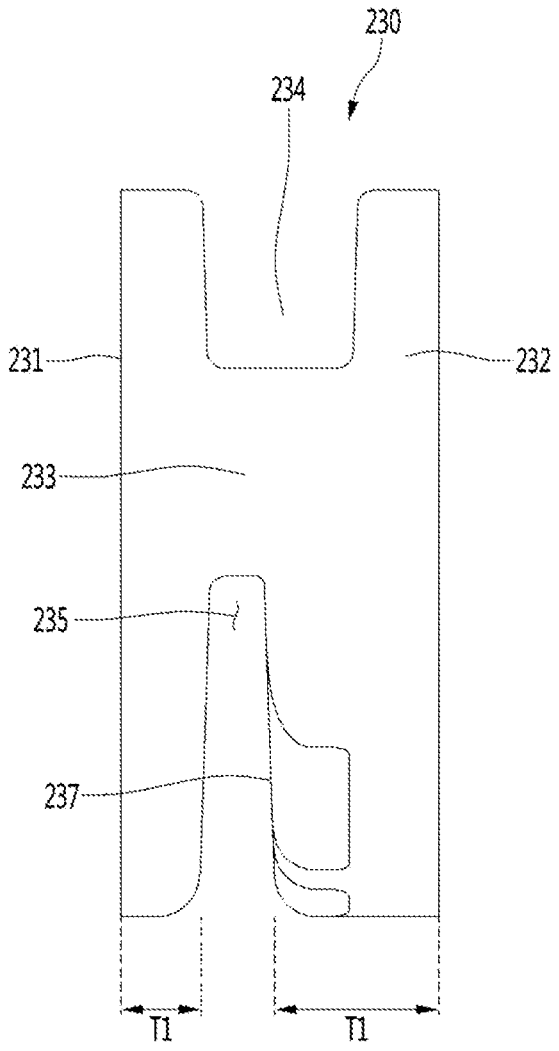

【Fig. 11】
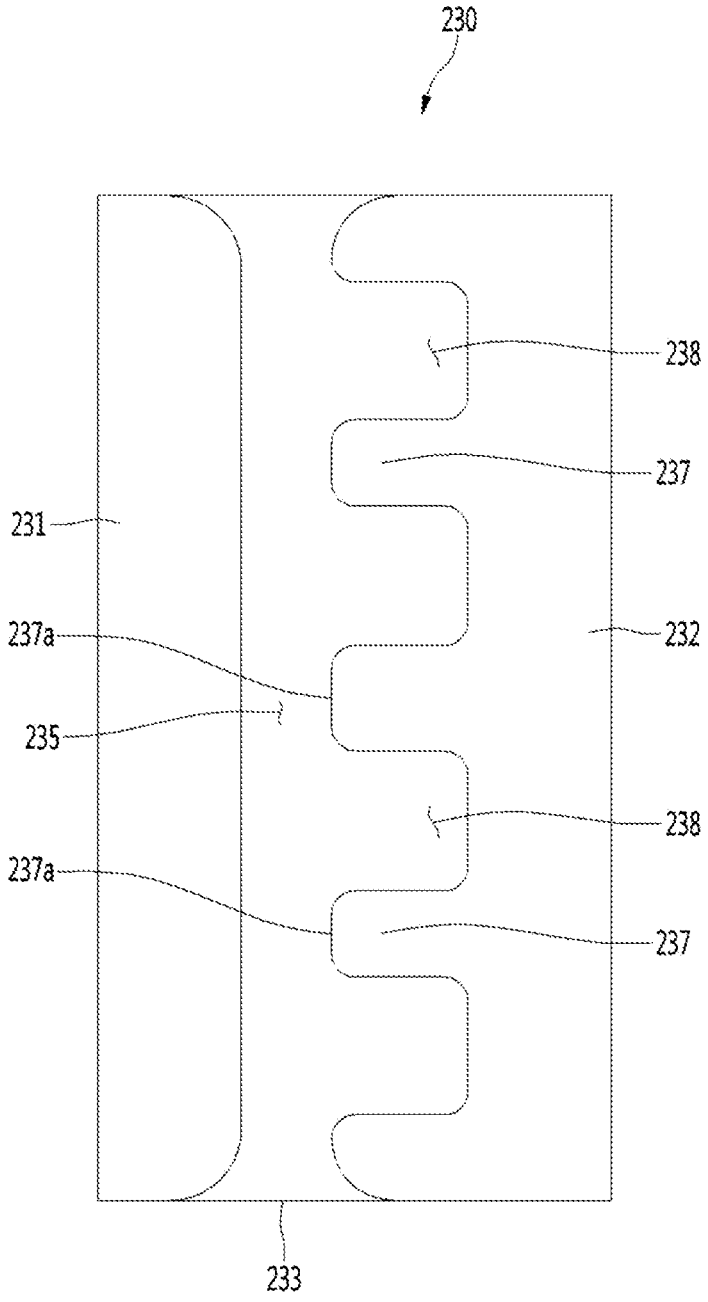

【Fig. 12】
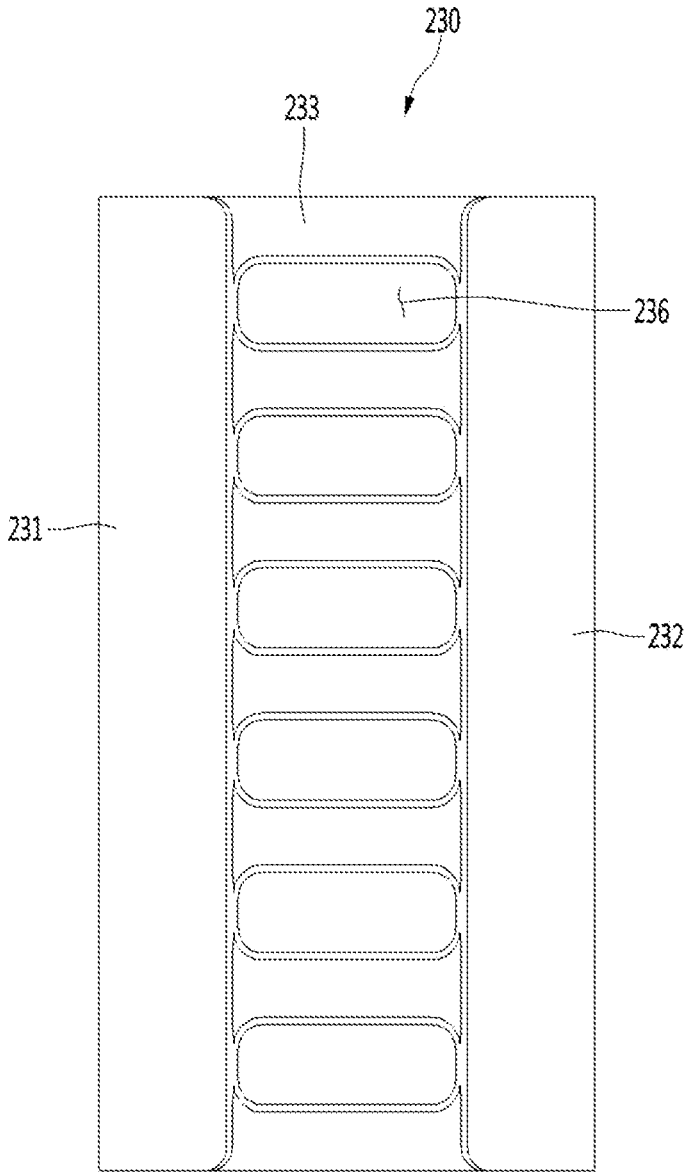

【Fig. 13】
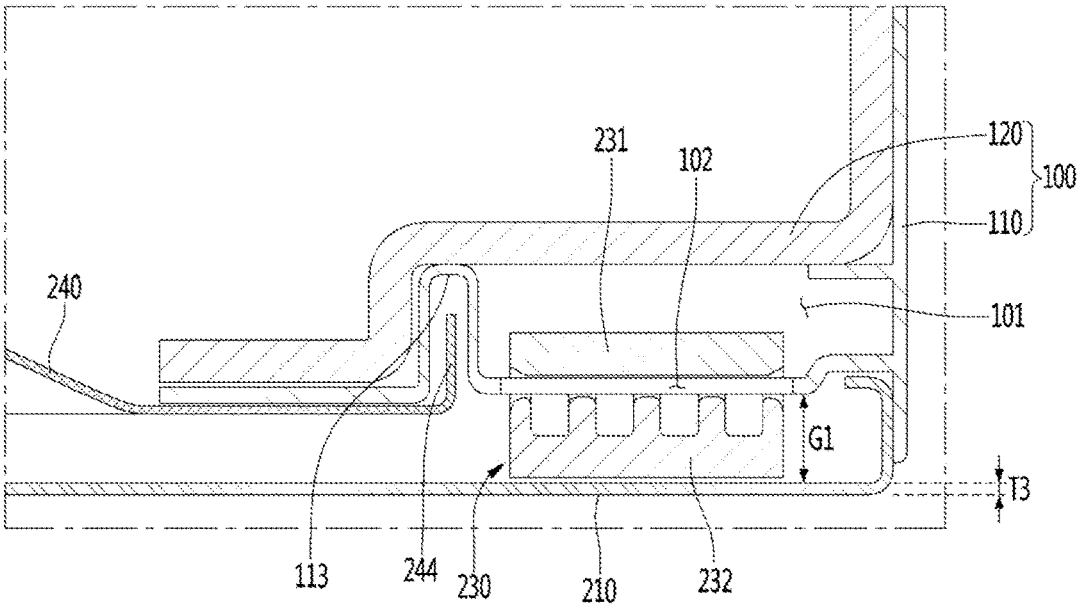
【Fig. 14】
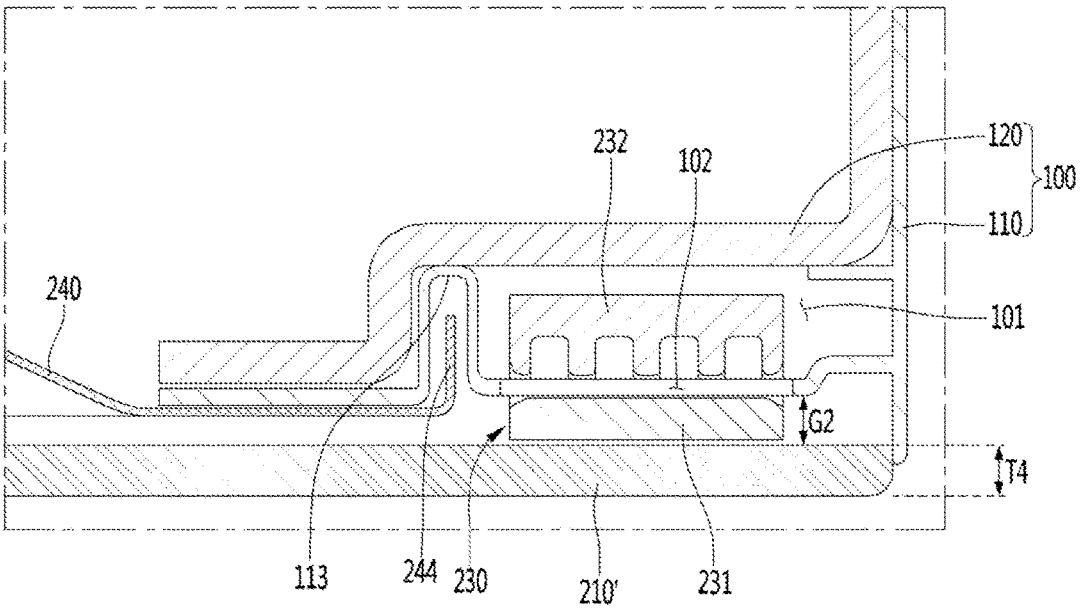

【Fig. 15】
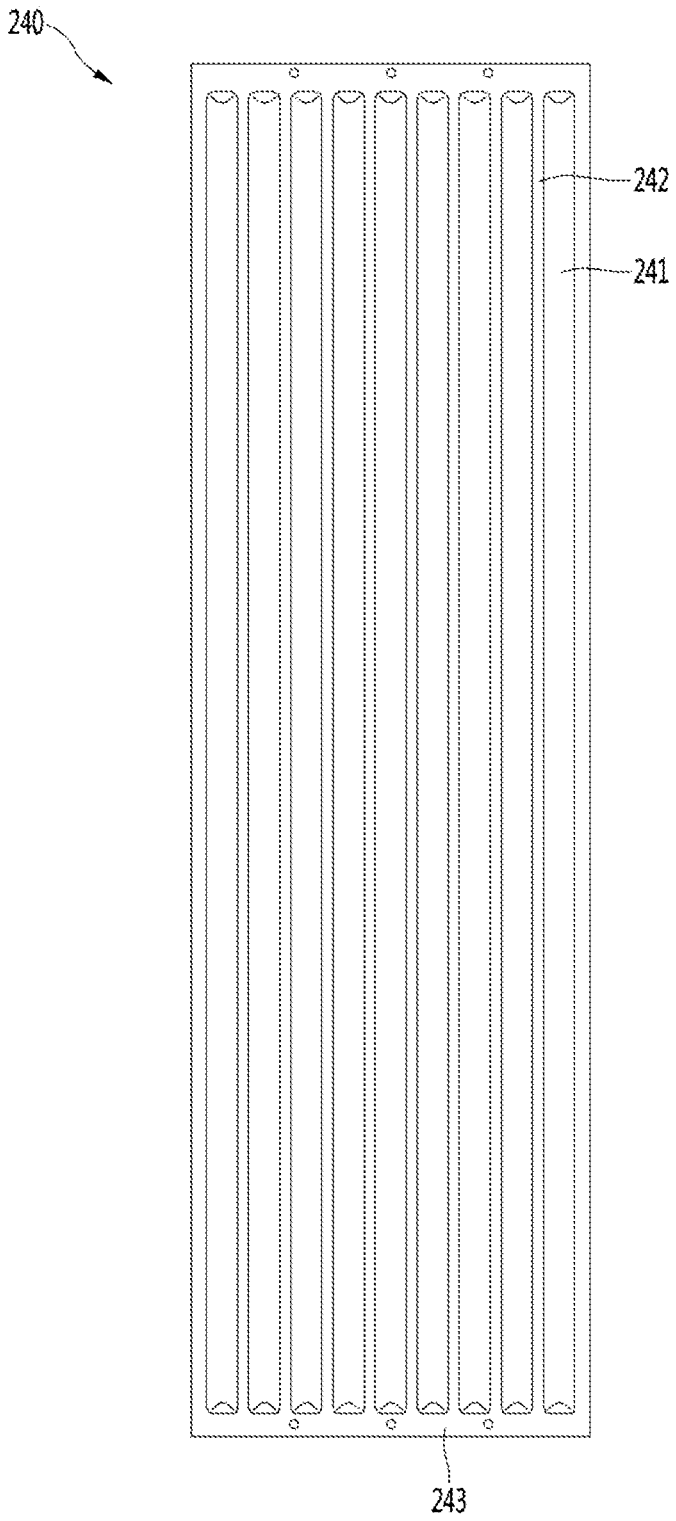

【Fig. 16】
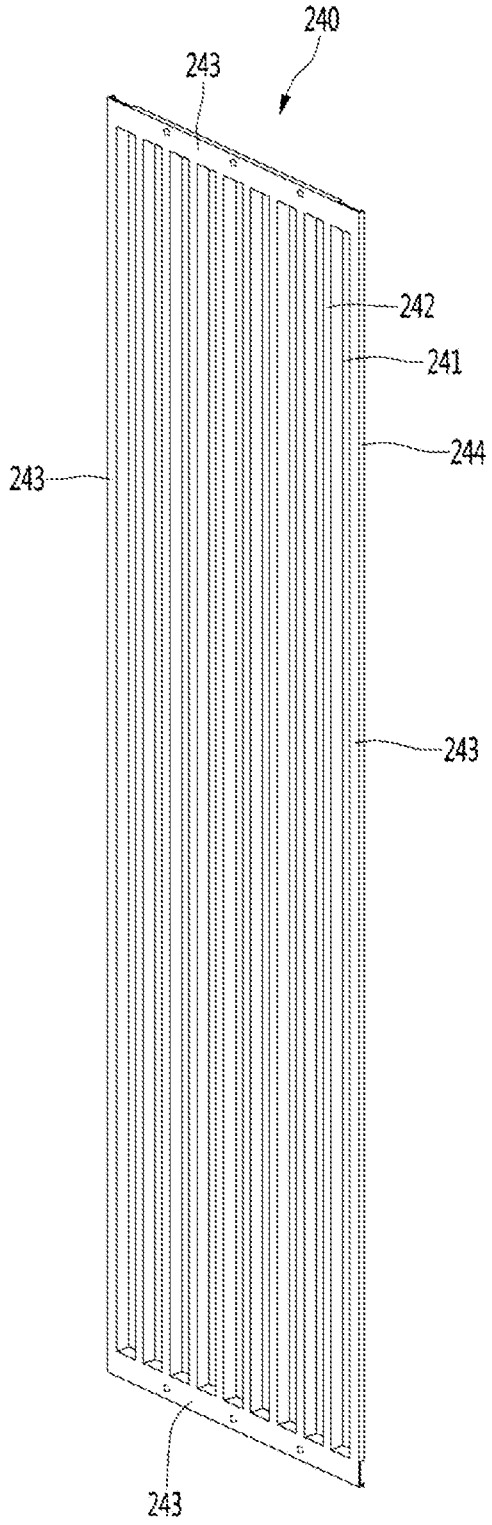

【Fig. 17】
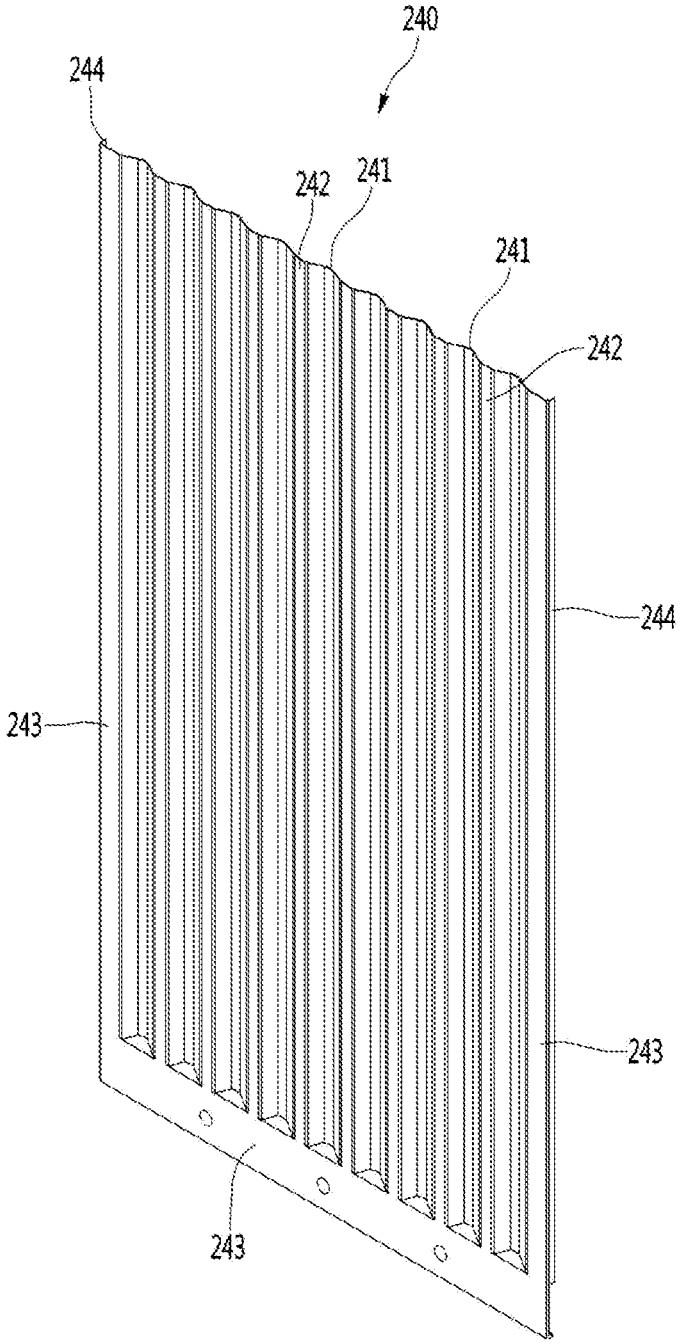

【Fig. 18】
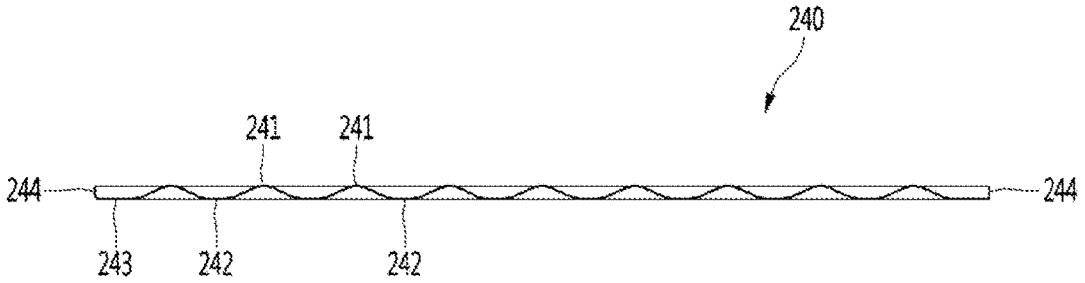

【Fig. 19】
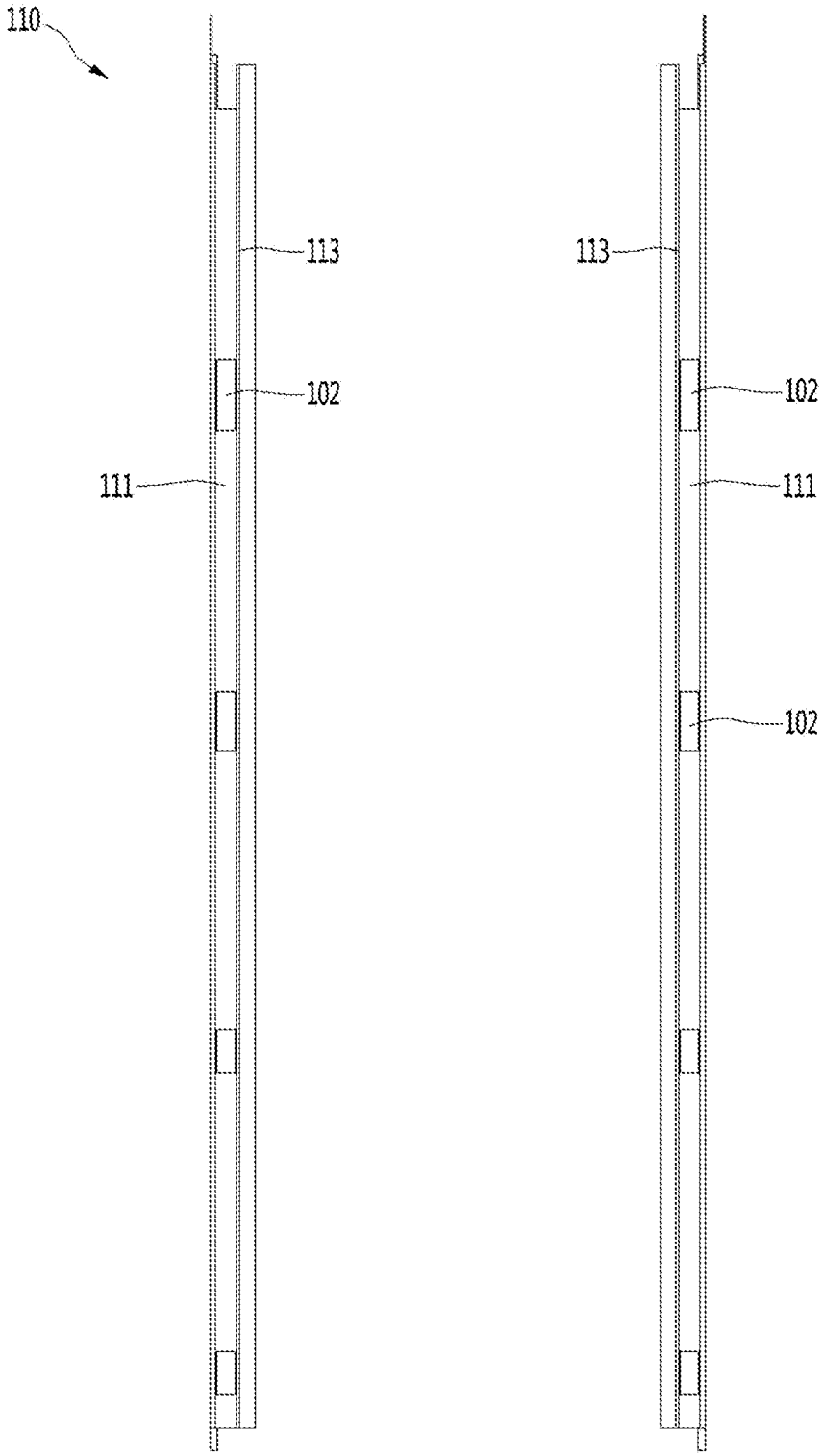

【Fig. 20】
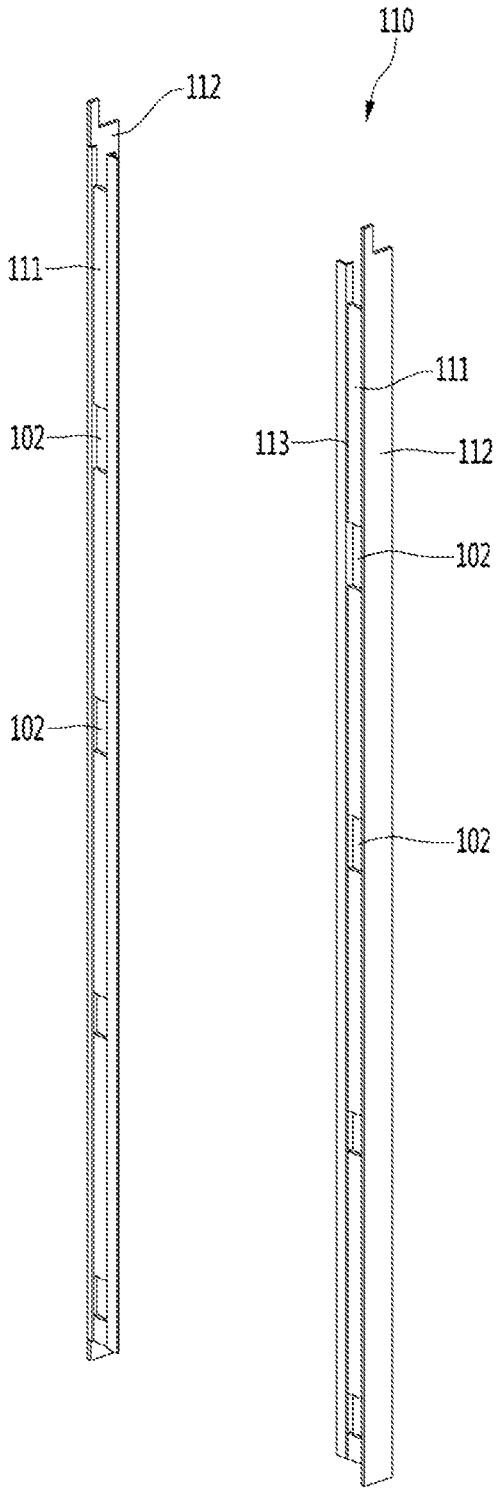

【Fig. 21】
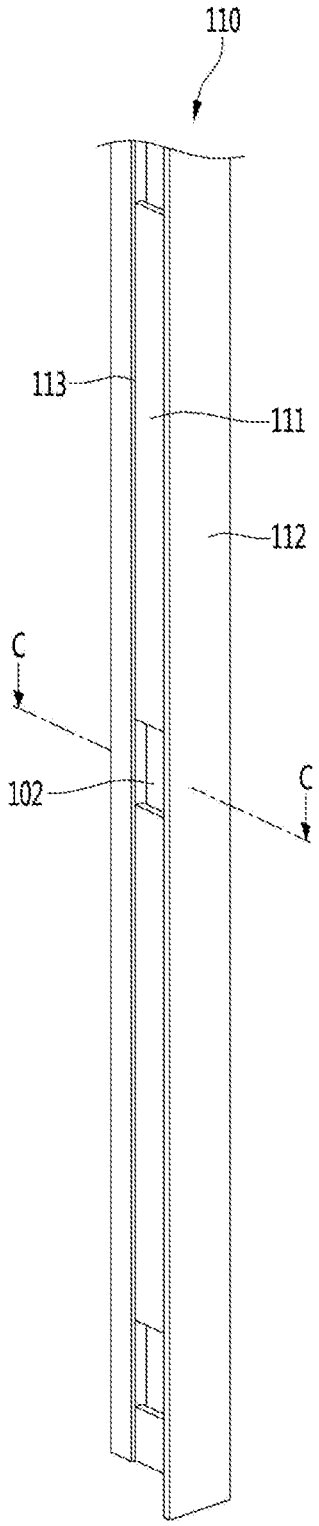

【Fig. 22】
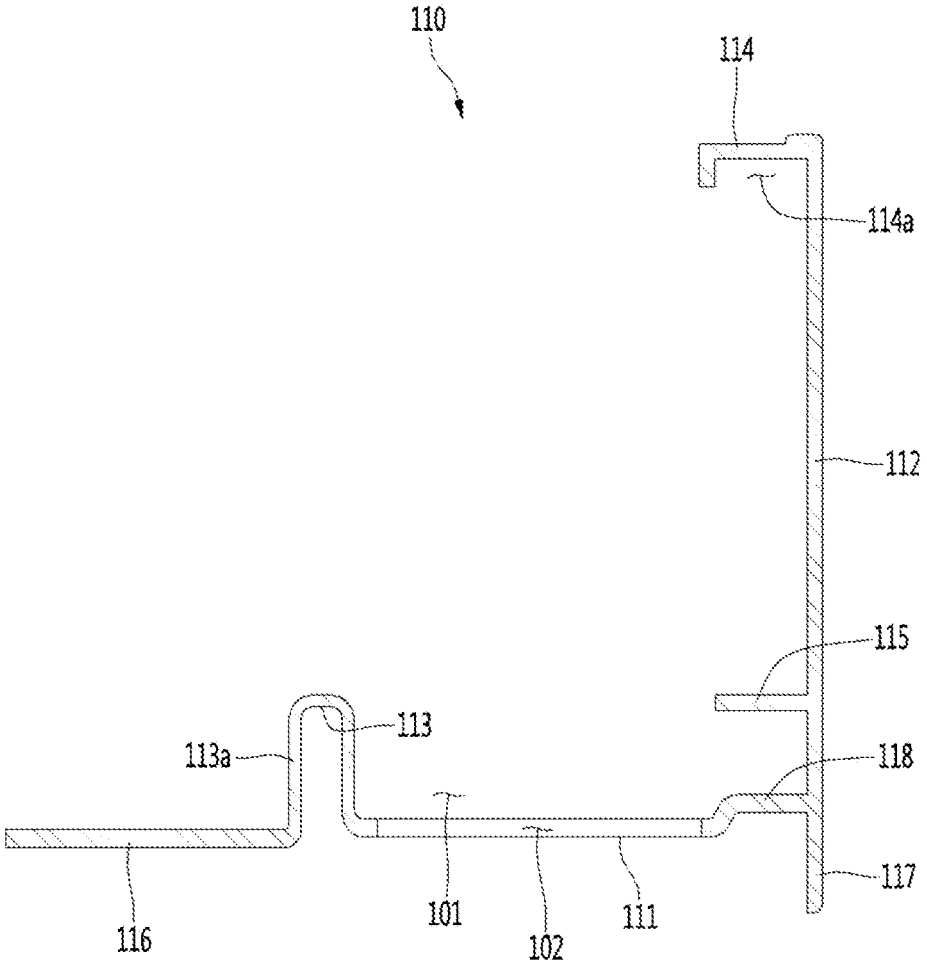

【Fig. 23】
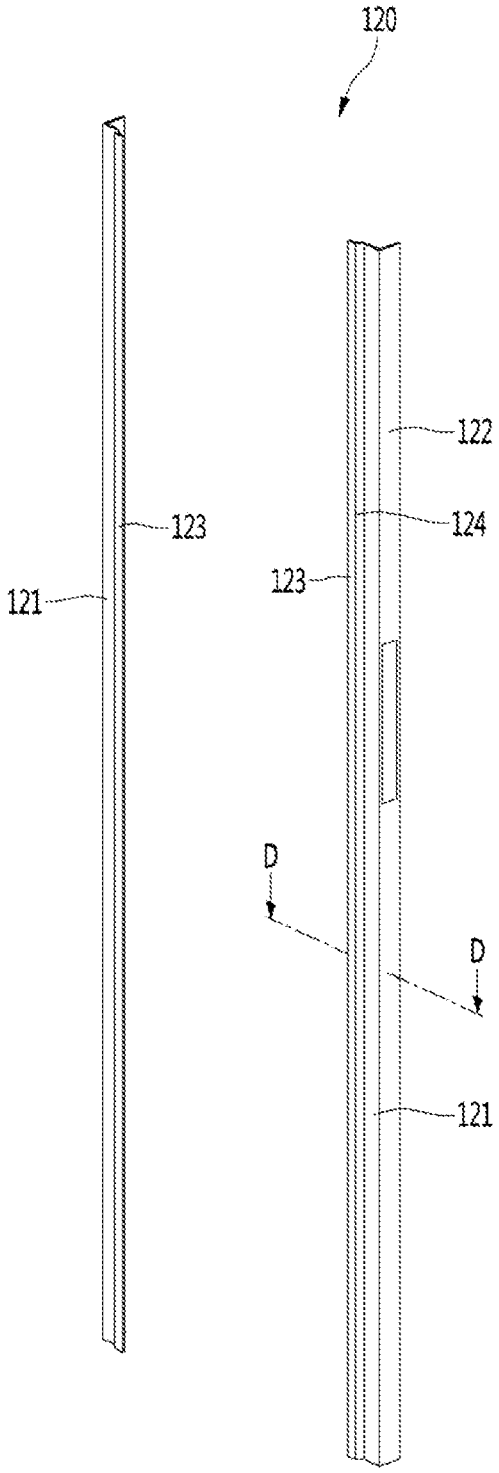

【Fig. 24】
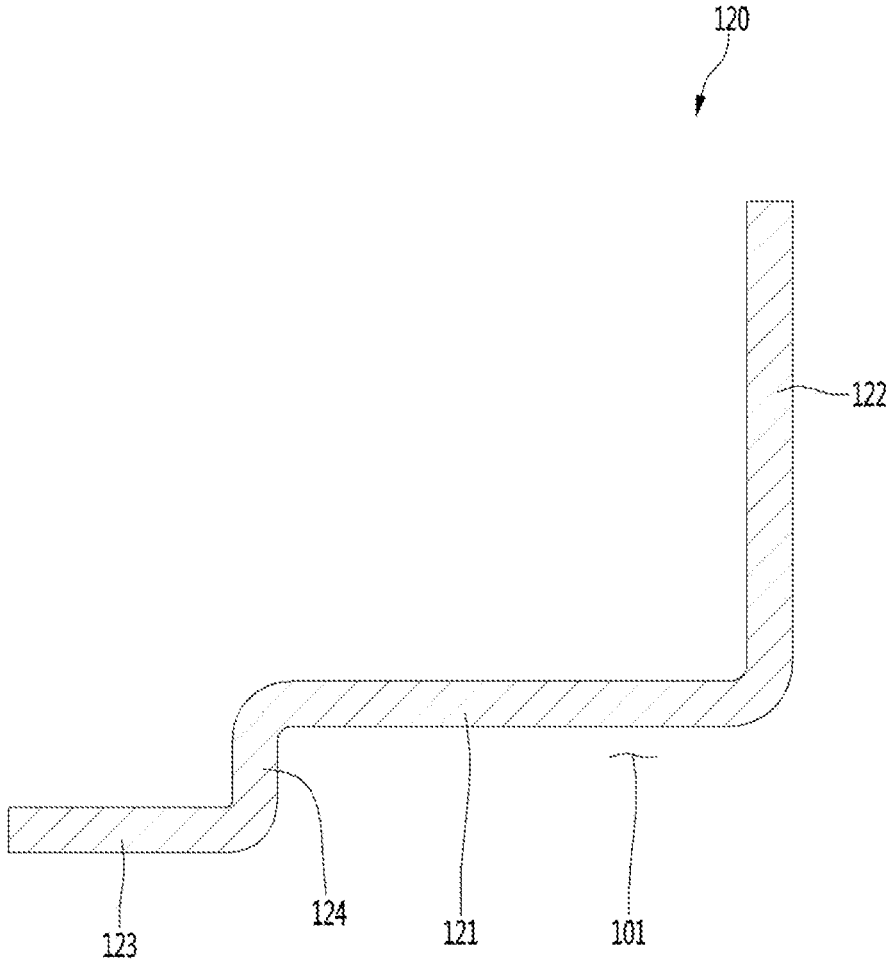

【Fig. 25】
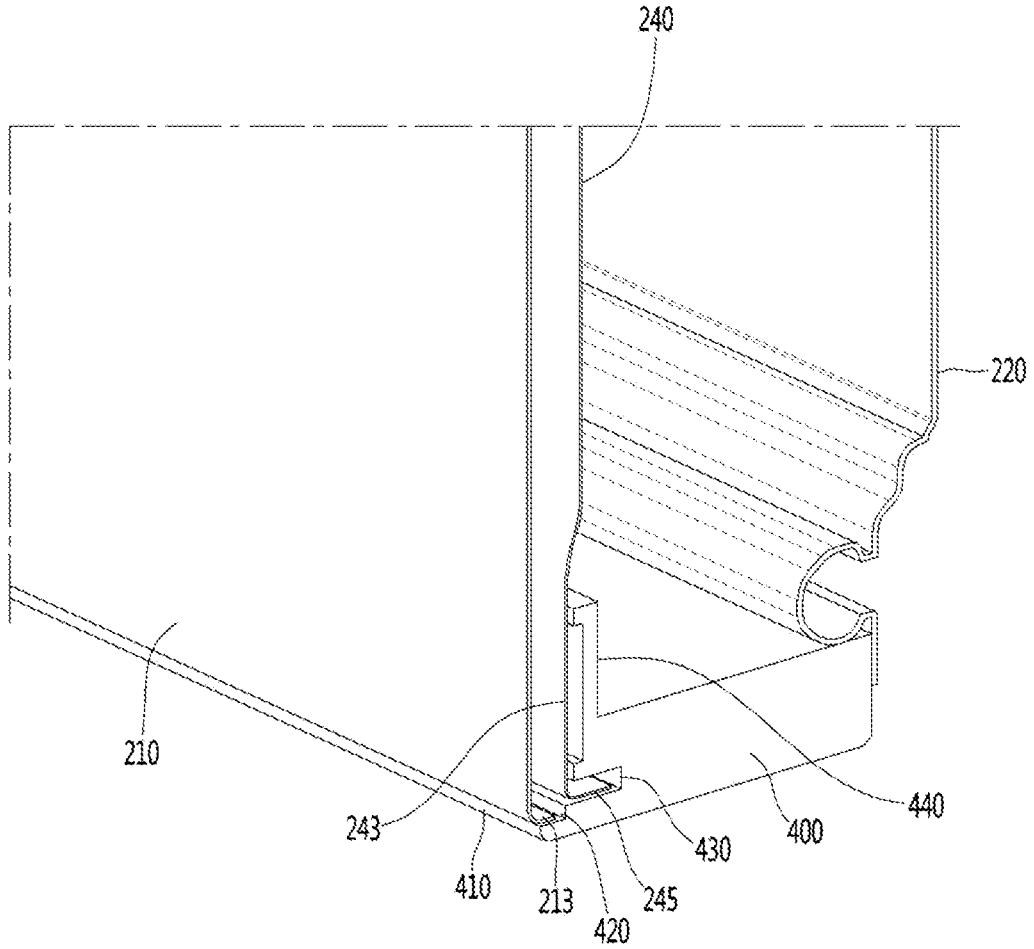

【Fig. 26】
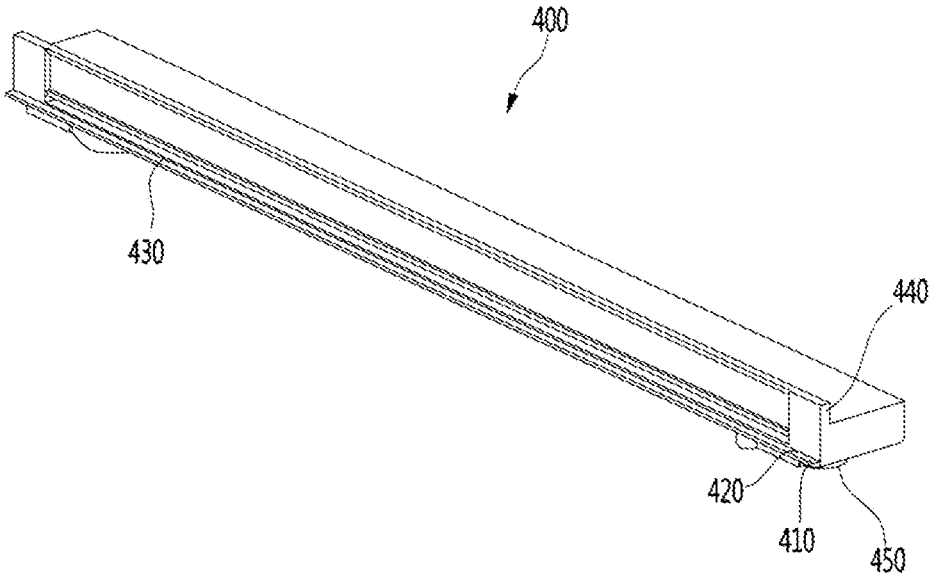

【Fig. 27】
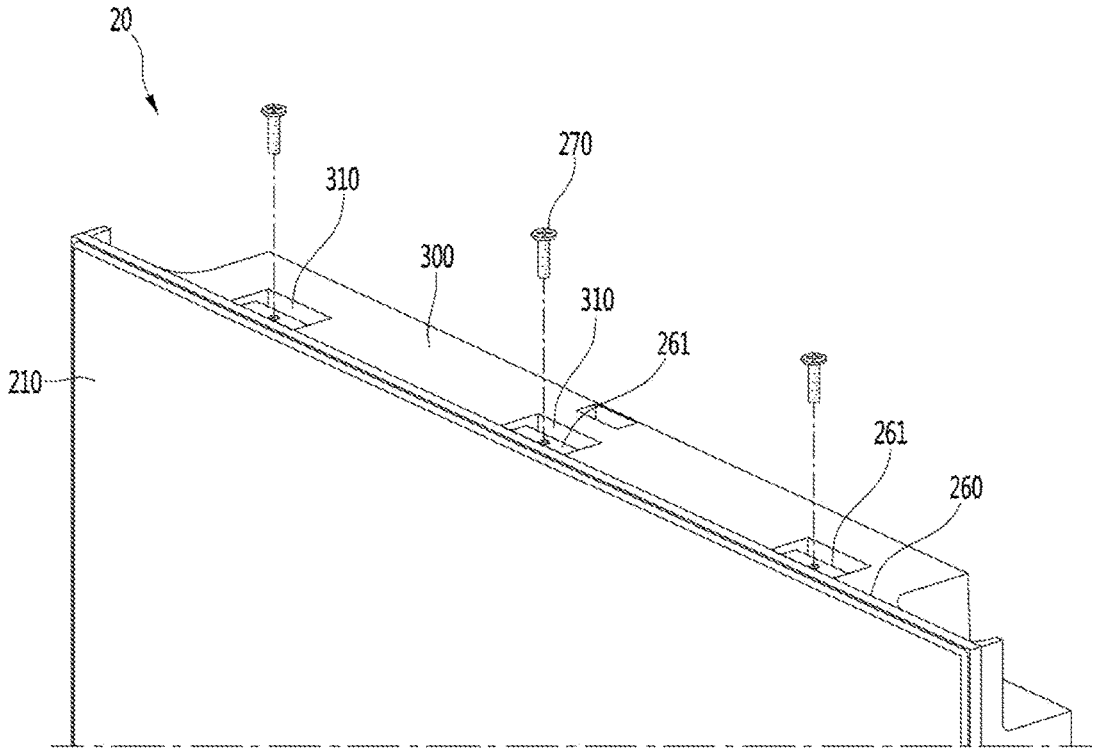

【Fig. 28】
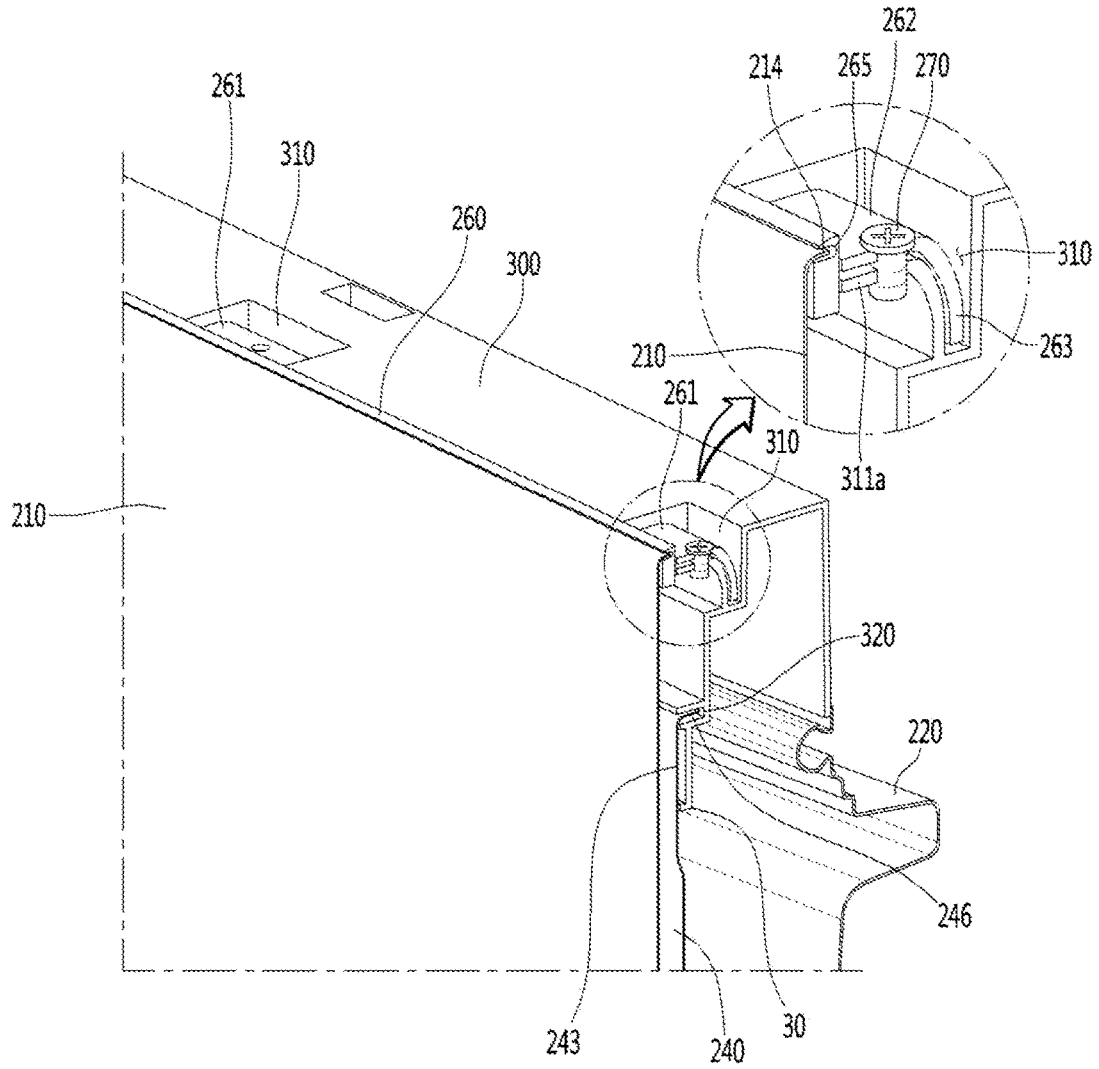

【Fig. 29】
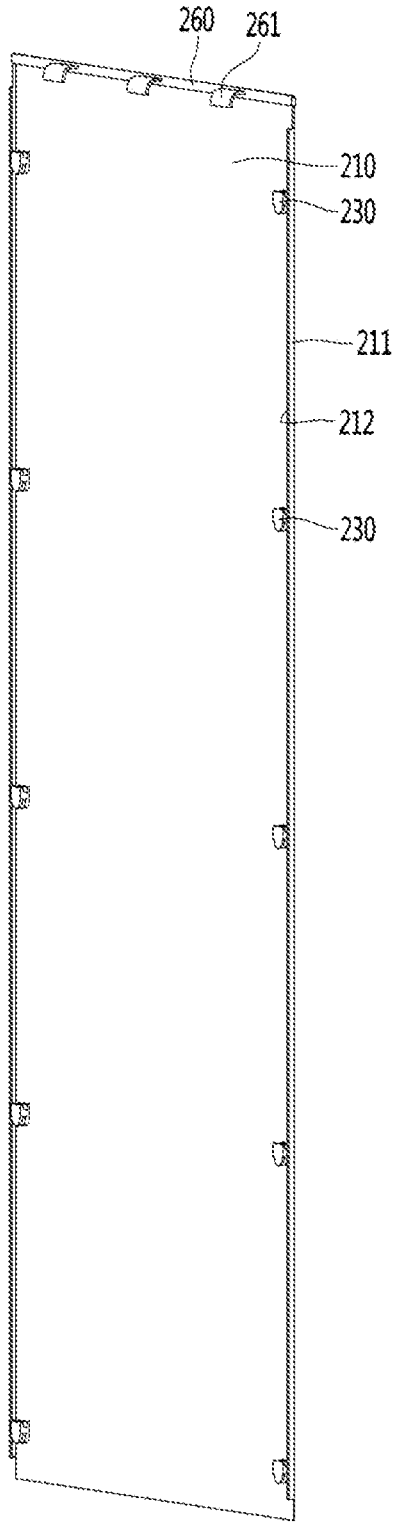

【Fig. 30】
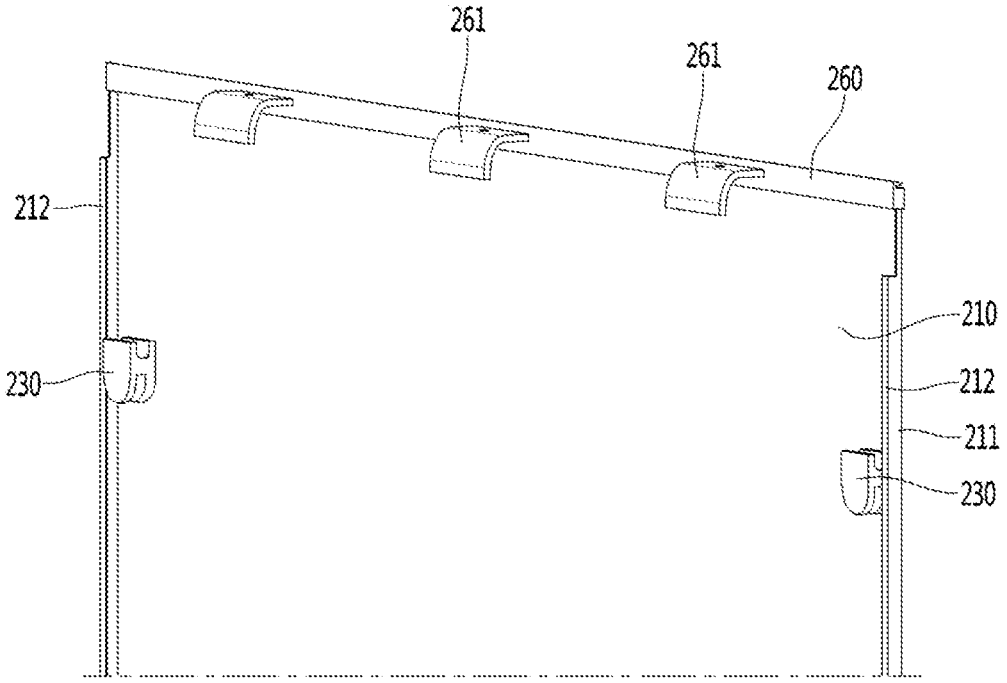

【Fig. 31】
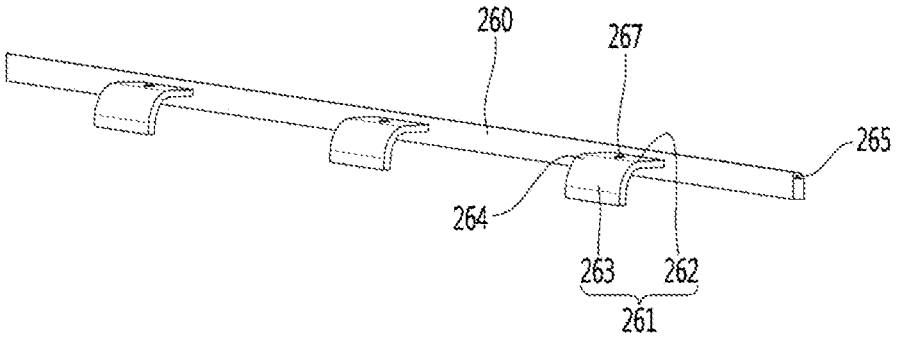

【Fig. 32】
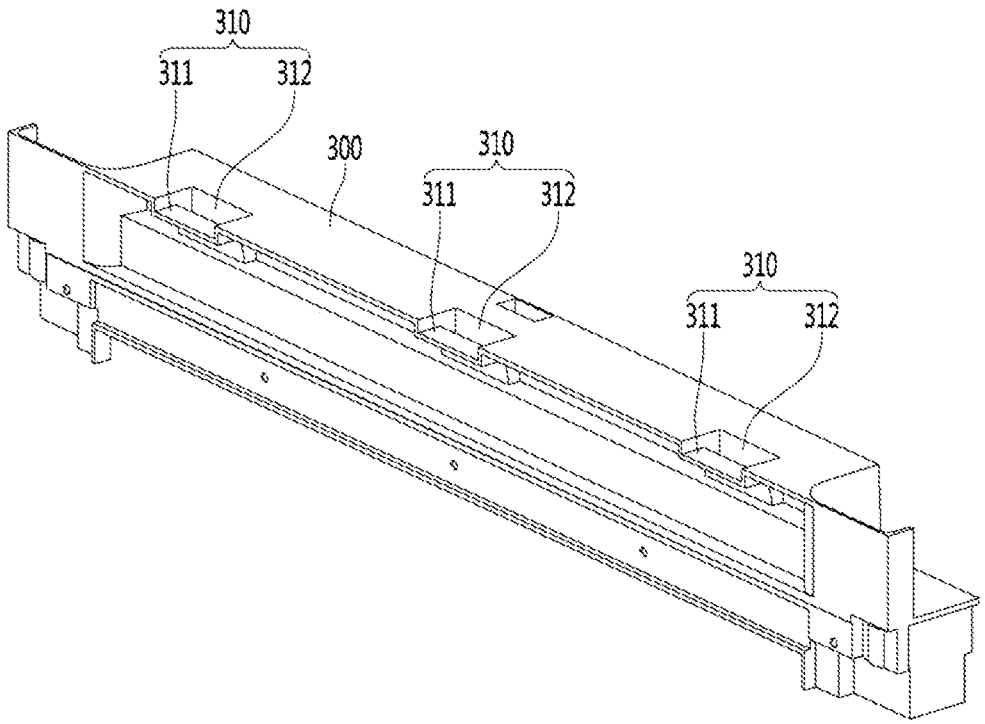

REFRIGERATOR

CROSS-REFERENCE TO RELATED APPLICATIONS

This application is a National Stage application under 35 U.S.C. § 371 of International Application No. PCT/KR2020/003309, filed on Mar. 10, 2020. The disclosures of the prior applications are incorporated by reference in their entirety.

TECHNICAL FIELD

The present disclosure relates to a refrigerator capable of replacing an outer pa of a refrigerator.

BACKGROUND ART

In general, a refrigerator is a home appliance for storing foods at a low temperature in a storage space that is covered by a door. To this end, the refrigerator is configured to keep stored food in an optimal state by cooling the inside of the storage space using cold air generated through heat exchange with a refrigerant circulating in a refrigeration cycle.

Recent refrigerators are gradually becoming larger and more multifunctional in accordance with the change in dietary habits and the trend of luxury products. Refrigerators having various structures and convenient devices for user convenience and efficient use of internal space have been released.

The storage space of the refrigerator may be opened or closed by a door. The door of the refrigerator constitutes the front surface of the refrigerator. A user opens the door of the refrigerator to take out food stored in the refrigerator, and closes the door to cool and store food in the refrigerator.

As described above, the door of the refrigerator is a component that is mainly operated by the user and needs to be easily opened or closed. In addition, the door of the refrigerator needs to be rigidly configured such that damage or failure does not occur in this process.

The door of the refrigerator includes a frame forming a framework and a panel member provided in front of the frame. The panel member may form a front exterior of the door.

On the other hand, the design of the refrigerator door, that is, the shape, material, or color of the refrigerator door may be an important criterion for a consumer to purchase a refrigerator. Since the shape, material, or color of the door desired by each consumer is different, a uniformly manufactured door design may lower the purchase intention of the user.

Even if the user wants to change the design of the door while using the refrigerator, the design change is limited and the user has to purchase a refrigerator of a different model.

In response to such a consumer's request, a refrigerator door is provided such that a panel member is detachable, and a manufacturer can provide a customized panel member suitable for a consumer's preference.

That is, the viewpoint of refrigerator users is changing that the refrigerator is a type of interior as well as food and beverage storage. In addition, individual interior characteristics are expressed through the color and material of the refrigerator. Accordingly, the refrigerator door also needs to be easily changed in color and material according to a user's interior taste.

The following prior art is disclosed in relation to a refrigerator door having a detachable panel member.

Prior Art Document 1

Japanese Patent Laid-Open No. 6460832 (registered on Jan. 11, 2019)

A cooling utility door disclosed in Prior Art Document 1 is provided with a glass panel in front of a support part and is configured to additionally provide an attachment part that allows the glass panel to be detachably provided to the support part.

The attachment part may include an adhesive plate, and the front surface of the adhesive plate may be bonded to the edge of the glass panel by an adhesive.

According to Prior Art Document 1, the following problems may appear.

Since the glass panel and the adhesive plate are bonded to each other through the adhesive, the glass panel is not easily removed due to the adhesive once the glass panel is assembled.

In addition, when the support part and the attachment part are provided only at the lower portion of the door and are coupled to each other through screws, there may be a problem in that the supporting force for the glass panel is weakened.

In addition, when a plurality of recessed parts are formed on the front surface of the support part and a plurality of attachment parts are provided in the vertical direction so as to be inserted into the recessed parts of the support part, the assembling has to be performed by aligning the recessed parts of the support part and the attachment parts and moving the glass panel to the rear. Accordingly, there is a problem in that an assembly process is complicated and difficult.

In addition, in the case of Prior Art Document 1, when the refrigerator is disposed of, it aims to more easily separate the glass panel from other parts for recycling. Therefore, upon using the refrigerator, it is difficult to replace the external panel.

Prior Art Document 2

Chinese Utility Model Publication No. 207299701U (published on May 1, 2018)

Prior Art Document 2 discloses a refrigerator having a detachable panel, wherein a panel is detached or attached using a magnetic strip.

Prior Art Document 3

Japanese Utility Model Publication S59-13990U (published on Jan. 27, 1984)

Prior Art Document 3 discloses a door device, wherein a panel is detached or attached using a magnet.

According to Prior Art Documents 2 and 3, the following problems may appear.

When the panel is detached using a magnet member, the panel detachment process can be easily performed, but there may be a problem regarding panel detachment due to the weakening of the magnetic force. In particular, the panel may be detached by the impact caused by repeated opening and closing of the door.

Since the panel may be attached by magnetic force even if the panel is not placed in the correct position, the possibility that the panel may be assembled in the wrong position according to the user's mistake appears.

DISCLOSURE

Technical Problem

The present embodiment provides a refrigerator in which a front panel forming the front of a refrigerator door can be easily replaced.

The present embodiment provides a refrigerator in which a front panel can be replaced without space limitation.

The present embodiment provides a refrigerator in which a front panel forming the front of a refrigerator door can be selected or manufactured according to preference and then attached.

The present embodiment provides a refrigerator in which the material and color of a front panel forming a bottom surface of a refrigerator door can be easily replaced.

The present embodiment provides a refrigerator in which a front panel coupled to a frame assembly can be easily separated from the frame assembly without a separate tool when the front panel is separated.

The present embodiment provides a refrigerator with reduced product cost and easy parts management by minimizing additional parts required to replace a front panel of a refrigerator door.

The present embodiment provides a refrigerator in which panels having different thicknesses can be alternately attached to a refrigerator door by changing an attachment direction of one component.

The present embodiment aims to provide a refrigerator in which front panels made of different materials can be alternately attached to a refrigerator door by using one component.

The present embodiment provides a refrigerator that can minimize the number of necessary parts by using one component, thereby reducing the manufacturing cost and facilitating inventory management.

The present embodiment provides a refrigerator in which a front panel can be attached from an outside of a refrigerator door by hanging the front panel from the top to the bottom of the refrigerator door.

The present embodiment provides a refrigerator in which a front panel can be separated from an outside of a refrigerator door by lifting the front panel from the bottom to the top of the refrigerator door.

The present embodiment provides a refrigerator capable of preventing deformation of a front panel by fixing both ends of the front panel to a frame assembly and solving the problem of floating at the edge of the front panel.

The present embodiment provides a refrigerator capable of preventing deformation of a refrigerator door.

Technical Solution

In order to solve the above problems, a refrigerator door according to an embodiment of the present disclosure includes a front panel and a frame assembly have a detachably coupled structure.

The front panel and the frame assembly may be connected to each other through a separate coupling means.

The frame assembly may be disposed in a line on both sides to form an edge of the refrigerator door, and a hollow portion may be formed in a longitudinal direction.

The front panel may be coupled to one side of the frame assembly to form a front surface of the refrigerator door.

The refrigerator door according to an embodiment of the present disclosure may further include a rear panel coupled to the other side of the frame assembly to form a rear surface of the refrigerator door.

Coupling holes communicating the hollow portion with an outside may be formed in one side facing the front panel, and the coupling holes may be spaced apart from each other in a vertical direction.

A coupling protrusion, at least a portion of which passes through the coupling hole and is accommodated in the hollow portion of the frame assembly, may be formed on a rear surface of the front panel.

The coupling protrusion formed on the rear surface of the front panel may engage the coupling hole of the frame assembly, such that the front panel can be easily supported by the frame assembly.

While both ends of the front panel are fixed to the frame assembly, deformation of the front panel may be prevented and lifting at the edge of the front panel may be prevented.

The coupling protrusion may be formed on a coupling member fixed to the rear surface of the front panel.

The coupling member may include: a second fixing part fixed to the rear surface of the front panel; a first fixing part passing through the coupling hole and accommodated in the hollow portion of the frame assembly; and a connection portion configured to connect the second fixing part to the first fixing part.

Surfaces facing outward in the second fixing part and the first fixing part may be flat surfaces.

The connection portion may be formed at a position spaced downward from upper ends of the second fixing part and the first fixing part.

The connection portion may be formed at a position spaced upward from lower ends of the second fixing part and the first fixing part.

The connection portion may have an intermediate groove that is concave downward from the upper end.

The second fixing part or the first fixing part may have a contact protrusion protruding inward from a surface facing inward.

A plurality of contact protrusions may be spaced apart from each other.

The second fixing part and the first fixing part may be formed to have different thicknesses.

The height of the connection part may be lower than the heights of the second fixing part and the first fixing part.

An upper groove having a downwardly concave shape may be formed on the connection portion between the second fixing part and the first fixing part, and a lower groove having an upwardly concave shape may be formed below the connection portion.

The interval between the lower grooves may be smaller than the interval between the upper grooves.

The coupling member may be fixed to the rear surface of the front panel by a hot-melt method or an adhesive method.

The front panel may be made of a metal material including a steel material, a glass material, or a plastic material.

A reinforcing panel may be disposed between the front panel and the rear panel.

The reinforcing panel may be provided with a corrugated steel plate having irregularities in a horizontal direction.

A heat insulating layer formed by foaming urethane may be formed between the front panel and the rear panel.

The frame assembly may include an outer frame including a first plane formed to face the front panel and a second plane formed on one side of the first plane and extending in a direction perpendicular to the first plane, the outer frame having the coupling groove formed in the first plane.

The frame assembly may include an inner frame including a third plane facing the first plane and a fourth plane extending from one side of the third plane in a vertical direction, the inner frame being disposed behind the outer frame to form the hollow portion.

A groove portion that is concave rearward may be formed on the other side of the first plane, an extension that is bent rearward may be formed at one end of the reinforcing panel disposed between the front panel and the rear panel, and the extension portion may be inserted into the groove portion.

The inner frame may further include a contact portion formed to make surface contact with the other end of the first plane, the third plane may be spaced apart from the first plane to form the hollow portion, and the inner frame may include an intermediate portion extending in a front-and-rear direction and configured to connect the contact portion to the third plane.

The second plane may form a seating portion extending inward in a horizontal direction, and one side of the third plane may be seated on the seating portion.

The second plane may include an accommodation portion extending inward from the rear end in a horizontal direction and then extending toward a front end in a vertical direction.

The second plane may further include a side portion protruding forward than the first plane.

The refrigerator door may further include a cap deco mounted on an upper end or a lower end of the refrigerator door and forming an upper surface or a lower surface of the refrigerator door.

The cap deco may include an upper cap deco mounted on the upper end of the refrigerator door, coupling grooves that are concave downward from the upper end may be formed in the upper cap deco, and the coupling grooves may be spaced apart from each other in a horizontal direction.

A plurality of bent coupling protrusions inserted into the coupling grooves may be formed on the upper end of the rear surface of the front panel.

A plate-shaped coupling member may be fixed to the upper end of the rear surface of the front panel, and the coupling protrusion may be integrally formed with the coupling member.

The coupling protrusion may include a first extension portion extending from the rear surface of the front panel in a horizontal direction, and a second extension portion extending vertically downward from the first extension portion.

The coupling groove may include a first groove in which the first extension portion is accommodated, and a second groove formed to be deeper than the first groove such that the second extension portion is accommodated therein.

When the coupling protrusion is accommodated in the coupling groove, at least a portion of the bottom surfaces of the first extension portion and the first groove portion is in surface contact with each other, and the first extension portion the first groove portion may be coupled to each other through a separate coupling means passing through the bottom surfaces of the first extension portion and the first groove portion in sequence.

Advantageous Effects

According to the present disclosure, it is possible to freely set the exterior of the door.

According to the present disclosure, the front panel forming the front of the refrigerator door can be easily replaced.

According to the present disclosure, it is possible to replace the front panel without space limitation.

According to the present disclosure, the material of the front panel forming the front of the refrigerator door can be replaced.

According to the present disclosure, the state in which the front panel is attached to the front of the refrigerator door can be maintained by its own weight without a separate means.

According to the present disclosure, the front panel forming the front of the refrigerator door can be selected or manufactured according to preference and then attached.

According to the present disclosure, the material and color of the front panel forming the bottom surface of the refrigerator door can be easily replaced.

According to the present disclosure, the front panel coupled to the frame assembly can be easily separated from the frame assembly without a separate tool when the front panel is separated.

According to the present disclosure, the product cost is reduced and parts management is facilitated by minimizing additional parts required to replace the front panel the refrigerator door.

According to the present disclosure, panels having different thicknesses can be alternately attached to the refrigerator door by changing the attachment direction of one component.

According to the present disclosure, front panels made of different materials can be alternately attached to the refrigerator door by using one component.

According to the present disclosure, it is possible to minimize the number of necessary parts by using one component, thereby reducing the manufacturing cost and facilitating inventory management.

According to the present disclosure, the front panel can be attached from the outside of the refrigerator door by hanging the front panel from the top to the bottom of the refrigerator door.

According to the present disclosure, the front panel can be separated from the outside of the refrigerator door by lifting the front panel from the bottom to the top of the refrigerator door.

According to the present disclosure, it is possible to prevent deformation of the front panel by fixing both ends of the front panel to the frame assembly and solving the problem of floating at the edge of the front panel.

DESCRIPTION OF DRAWINGS

FIG. 1 is a view showing a state in which a refrigerator is installed in a furniture cabinet according to an embodiment of the present disclosure.

FIG. 2 is a perspective view of a refrigerator according to an embodiment of the present disclosure.

FIG. 3 is a perspective view of a refrigerator door according to an embodiment of the present disclosure.

FIG. 4 is an exploded perspective view of a refrigerator door according to an embodiment of the present disclosure.

FIG. 5 is a cross-sectional view taken along line A-A of FIG. 3.

FIG. 6 is an enlarged view of region 'B' of FIG. 5.

FIG. 7 is a perspective view showing a state in which a coupling member is inserted into a coupling hole of a frame assembly according to an embodiment of the present disclosure.

FIG. 8 is a perspective view of a coupling member according to an embodiment of the present disclosure.

FIG. 9 is a rear perspective view of a coupling member according to an embodiment of the present disclosure.

FIG. 10 is a side view of a coupling member according to an embodiment of the present disclosure.

FIG. 11 is a bottom view of a coupling member according to an embodiment of the present disclosure.

FIG. 12 is a plan view of a coupling member according to an embodiment of the present disclosure.

FIG. 13 is a cross-sectional view showing a state in which a front panel made of a steel material is mounted on a refrigerator door according to an embodiment of the present disclosure.

FIG. 14 is a cross-sectional view showing a state in which a front panel made of a glass material is mounted on a refrigerator door according to an embodiment of the present disclosure.

FIG. 15 is a front view of a reinforcing panel according to an embodiment of the present disclosure.

FIG. 16 is a perspective view of a reinforcing panel according to an embodiment of the present disclosure.

FIG. 17 is a perspective view showing a state in which a reinforcing panel is cut in a transverse direction according to an embodiment of the present disclosure.

FIG. 18 is a cross-sectional view of a reinforcing panel according to an embodiment of the present disclosure.

FIG. 19 is a front view of an outer frame according to an embodiment of the present disclosure.

FIG. 20 is a perspective view of an outer frame according to an embodiment of the present disclosure.

FIG. 21 is an enlarged perspective view of a portion of FIG. 20.

FIG. 22 is a cross-sectional view taken along line C-C of FIG. 21.

FIG. 23 is a perspective view of an inner frame according to an embodiment of the present disclosure.

FIG. 24 is a cross-sectional view taken along line D-D of FIG. 23.

FIG. 25 is a partially cut-away perspective view of a lower side of a refrigerator door according to an embodiment of the present disclosure.

FIG. 26 is a perspective view of a lower frame according to an embodiment of the present disclosure.

FIG. 27 is an enlarged perspective view of an upper portion of a refrigerator door according to an embodiment of the present disclosure.

FIG. 28 is a partially cut-away perspective view of an upper side of a refrigerator door according to an embodiment of to the present disclosure.

FIG. 29 is a rear perspective view of a front panel according to an embodiment of the present disclosure.

FIG. 30 is an enlarged perspective view of a portion of FIG. 29.

FIG. 31 is a perspective view of a coupling member according to an embodiment of the present disclosure.

FIG. 32 is a perspective view of a cap deco according to an embodiment of the present disclosure.

MODE FOR INVENTION

Hereinafter, some embodiments of the present disclosure will be described in detail with reference to exemplary drawings. In assigning reference numerals to the components of the drawings, it should be noted that the same components are denoted by the same reference numerals as much as possible even though the components are shown in different drawings. In addition, in describing the embodiments of the present disclosure, if the detailed description of the relevant known functions or configurations is determined to unnecessarily obscure the gist of the present disclosure, the detailed description thereof is omitted.

In addition, the terms, such as "first", "second", "A", "B", "(a)", or "(b)" may be used herein to describe the components of the present disclosure. These terms are only for distinguishing one component from another, and the essence, order, or sequence of the components is not limited by the terms. When one component is described as being "connected", "coupled", or "linked" to another component, the component may be directly connected or coupled to the other component, but it should be understood that another component may be "connected", "coupled" or "linked" between components.

FIG. 1 is a view showing a state in which a refrigerator is installed in a furniture cabinet according to an embodiment of the present disclosure. FIG. 2 is a perspective view of a refrigerator according to an embodiment of the present disclosure.

Referring to FIGS. 1 to 2, a refrigerator 10 according to the present embodiment may be disposed independently or together with another refrigerator 5 in a kitchen or living room.

In addition, the refrigerator 5 may be disposed alone in a kitchen or living room, or may be disposed in a kitchen or living room as a single module together with other furniture or home appliances.

In this case, a furniture cabinet 1 in which the refrigerators 5 and 10 can be accommodated may be provided in the kitchen or living room. The height of the accommodation space inside the furniture cabinet 1 may be set such that a gap between the upper surfaces of the refrigerators 5 and 10 and the upper wall of the furniture cabinet 1 is not great in a state where the refrigerators 5 and 10 are accommodated.

If the gap between the upper surfaces of the refrigerators 5 and 10 and the upper wall of the furniture cabinet 1 is not great, the upper structure of the refrigerators 5 and 10 is not visible from the outside, and thus, the sense of unity between the furniture cabinet 1 and the refrigerators 5 and 10 may be increased.

In addition, the gap between the side surfaces of the refrigerators 5 and 10 and the inner wall of the furniture cabinet 1 may also be set not to be great. As described above, if the gap between the side surfaces of the refrigerators 5 and 10 and the inner wall of the furniture cabinet 1 is not great, the sense of unity between the furniture cabinet 1 and the refrigerators 5 and 10 from the outside may be increased.

The refrigerator 10 may include a cabinet 11 having a storage space and a refrigerator door 20 configured to open or close the storage space.

The refrigerator door 20 may be connected to the cabinet 11 through a hinge 16 and may open or close the storage space while rotating.

In addition, the refrigerator door 6 of another refrigerator accommodated in the furniture cabinet 1 may include a plurality of doors 7, 8, and 9 spaced apart from each other in the vertical direction. All or part of the plurality of doors 7, 8, and 9 may open or close the storage space in a sliding or rotating manner.

For reference, a refrigerating compartment may be provided inside the cabinet 11. In addition, a freezing compartment may be provided inside the cabinet 11. In addition, a refrigerating compartment and a freezing compartment may be provided together inside the cabinet 11.

FIG. 3 is a perspective view of a refrigerator door according to an embodiment of the present disclosure. FIG.

4 is an exploded perspective view of the refrigerator door according to an embodiment of the present disclosure.

Referring to FIGS. 3 to 4, the refrigerator door 20 may include a frame assembly 100 forming an outer appearance and a panel assembly 200 detachably coupled to the frame assembly 100.

The panel assembly 200 may form all or part of the front exterior of the refrigerator door 20. The front exterior of the refrigerator door 20 may substantially form the front exterior of the refrigerator 10.

Accordingly, the user can see the front of the panel assembly 200 from the front of the refrigerator 10. The front surface of the panel assembly 200 may serve as a decorative panel at a place where the refrigerator 10 is installed. In the present embodiment, the panel assembly 200 may be replaced according to a user's preference. That is, according to the present disclosure, the user can easily separate the front surface of the panel assembly 200 and replace the front surface with a design suitable for his or her taste.

Hereinafter, the refrigerator door 20 in which the panel assembly 200 can be easily replaced in the refrigerator disposed alone and the panel assembly 200 can be replaced without a space limitation even when the refrigerator 10 is accommodated in the furniture cabinet 1 will be described.

Referring to FIG. 4, the refrigerator door 20 according to an embodiment of the present disclosure may include the panel assembly 200 including a front panel 210 forming the front of the refrigerator door 20, a rear panel 220 forming the rear surface of the refrigerator door 20, and a reinforcing panel 240 disposed between the front panel 210 and the rear panel 220.

In addition, the refrigerator door 20 may include the frame assembly 100 including an outer frame 110 and an inner frame 120 and disposed in a line on both sides of the refrigerator door 20.

In addition, a coupling member 230 fixed to the rear surface of the front panel 210 may be included. Here, the coupling member 230 may be fitted into a coupling hole 102 of the outer frame 110.

In addition, the refrigerator door 20 may include a cap deco 300 and a lower frame 400, which form an upper surface and a lower surface of the refrigerator door 20 and are coupled to the frame assembly 100 and the panel assembly 200.

FIG. 5 is a cross-sectional view taken along line A-A of FIG. 3, and FIG. 6 is an enlarged view of region 'B' of FIG. 5.

Referring to FIGS. 5 to 6, the refrigerator door 20 may include the frame assembly 100 and the panel assembly 200.

First, the frame assembly 100 is disposed in a line on both sides to form an edge of the refrigerator door 20, and a hollow portion 101 is formed in the longitudinal direction. Here, the longitudinal direction may refer to a vertical direction.

For example, the hollow portion 101 may be formed in a rectangular shape.

In addition, the panel assembly 200 may include a front panel 210 coupled to one side of the frame assembly 100 to form the front surface of the refrigerator door 20, and a rear panel 220 coupled to the other side of the frame assembly 100 to form the rear surface of the refrigerator door 20.

In addition, in the frame assembly 100, a coupling hole 102 communicating the hollow portion 101 with the outside may be formed on one side facing the front panel 210, and the coupling holes 102 may be spaced apart in the vertical direction.

For example, the coupling hole 102 may be provided in the shape of a long hole in the vertical direction.

As another example, the coupling hole 102 may be formed in a rectangular shape.

In addition, a coupling protrusion, at least a portion of which passes through the coupling hole 102 and is accommodated in the hollow portion 101 of the frame assembly 200, may be formed on the rear surface of the front panel 210.

For example, the coupling protrusion 231 may be provided in a hook or clip shape.

As another example, the coupling protrusion 231 may include a first extension portion extending in the direction of the rear panel 220 in the front panel 210, and a second extension portion extending downward from the first extension portion. Here, the first extension portion and the second extension portion may be perpendicular to each other.

In a state where the panel assembly 200 is mounted on the frame assembly 100, the second extension portion may be accommodated in the hollow part 101, and the first extension portion may be in contact with and supported by the lower end of the coupling hole 102 while passing through the coupling hole 102.

When the coupling protrusion 231 is supported on the frame assembly 100 through the coupling hole 102 and the hollow portion 101 as described above, the front panel 210 to which the coupling protrusion 231 is fixed may be fixed to the frame assembly 100.

Due to the weight of the front panel 210, the coupling protrusion 231 may maintain a state of being fitted into the coupling hole 102 and the hollow portion 101.

For example, the coupling protrusion 231 may be integrally formed on the rear surface of the front panel 210.

As another example, the coupling protrusion 231 may be provided as a member separate from the front panel 210, and may be coupled to the rear surface of the front panel 210.

As another example, the coupling protrusion 231 may be detachably attached to the rear surface of the front panel 210.

On the other hand, the coupling protrusion 231 needs to be easily inserted into the coupling hole 102. Accordingly, the width of the coupling hole 102 in the left-and-right direction may be equal to or greater than the width of the coupling protrusion 231 in the left-and-right direction.

In addition, the vertical length of the coupling hole 102 may be equal to or greater than the vertical length of the coupling protrusion 231 so that the coupling protrusion 231 can be easily inserted into the coupling hole 102.

Referring to FIGS. 5 to 6, a heat insulating layer 250 made of a heat insulating material may be formed between the reinforcing panel 240 and the rear panel 220.

Hereinafter, the 'coupling member' will be described in more detail with reference to the drawings.

FIG. 7 is a perspective view showing a state in which the coupling member is inserted into the coupling hole of the frame assembly according to an embodiment of the present disclosure. FIG. 8 is a perspective view of the coupling member according to an embodiment of the present disclosure. FIG. 9 is a rear perspective view of the coupling member according to an embodiment of the present disclosure. FIG. 10 is a side view of the coupling member according to an embodiment of the present disclosure. FIG. 11 is a bottom view of the coupling member according to an embodiment of the present disclosure, and FIG. 12 is a plan view of the coupling member according to an embodiment of the present disclosure.

Referring to 7 to 12, the coupling protrusion 231 may be formed on the coupling member 230 fixed to the rear surface of the front panel 210.

The coupling member 230 may be attached adjacent to both ends of the front panel 210.

When the coupling member 230 is attached adjacent to both ends of the front panel 210 as described above, both ends of the front panel 210 may be fixed to the frame assembly 100. Accordingly, deformation of the front panel 210 can be prevented, and the problem of lifting at the edge of the front panel 210 can be solved.

In addition, the coupling member 230 may be attached to the upper end and the lower end of the front panel 210. That is, the coupling member 230 may be attached to both upper ends and both lower ends of the front panel 210. At this time, the frame assembly 100 is in a state where the coupling hole 102 is formed in accordance with the position of the coupling member 230.

As described above, when the coupling member 230 is attached to the upper end and lower end of the front panel 210, the upper end and lower end of the front panel 210 may also be fixed to the frame assembly 100. Accordingly, deformation of the front panel 210 can be more reliably prevented, and the problem of lifting at the upper end and lower end of the front panel 210 can be solved.

In addition, the coupling member 230 may be fixed to the rear surface of the front panel 210 by various methods.

For example, the coupling member 230 may be fixed to the rear surface of the front panel 210 by a hot-melt method or an adhesive method.

As another example, the coupling member 230 may be detachably coupled to the rear surface of the front panel 210.

For example, the coupling member 230 may be coupled to the rear surface of the front panel 210 through a coupling means such as a separate screw or bolt.

The coupling member 230 may be made of a plastic material or a metal material.

On the other hand, the coupling member 230 may include a second fixing part 232 fixed to the rear surface of the front panel 210, and coupling protrusions 231 and 233 protruded from the second fixing part 232 and inserted into and fixed to the coupling hole 102.

In addition, the coupling protrusions 231 and 233 may include a first fixing part 231 passed through the coupling hole 102 and accommodated in the hollow part 101 of the frame assembly 100, and a connection part 233 connecting the second fixing part 232 to the first fixing part 231.

The second fixing part 232 and the first fixing part 231 may be formed so that at least a portion of the surface facing outward is flat.

For example, the second fixing part 232 and the first fixing part 231 may be formed so that the entire surface facing outward is flat.

In the case of the second fixing part 232 and the first fixing part 231, the surface facing outward may be attached to the rear surface of the front panel 210 in various ways, such as bonding or heat staking.

Therefore, it is preferable that the second fixing part 232 and the first fixing part 231 have a flat surface facing outward so as to facilitate adhesion to the rear surface of the front panel 210.

In addition, at least a portion of the second fixing part 232 and the first fixing part 231 facing each other may be formed as a flat surface.

The connection part 233 may be formed at a position spaced downward from the upper ends of the second fixing part 232 and the first fixing part 231.

Accordingly, an upper groove 234 that is concave downward may be formed on the upper side of the connection part 233.

The upper groove 234 may be defined by the upper surfaces of the second fixing part 232, the first fixing part 231, and the connection part 233.

In addition, the connection part 233 may be formed at a position spaced upward from the lower ends of the second fixing part 232 and the first fixing part 231.

Accordingly, a lower groove 235 that is concave upward may be formed on the lower side of the connection part 233.

The lower groove 235 may be defined by the lower surfaces of the second fixing part 232, the first fixing part 231, and the connection part 233.

In addition, the height of the connection part 233 may be lower than the heights of the second fixing part 232 and the first fixing part 231.

When the height of the connection part 233 is formed to be lower than the heights of the second fixing part 232 and the first fixing part 231 as described above, the lower groove 235 having an upwardly concave shape may be formed below the connection part 233 between the second fixing part 232 and the first fixing part 231.

In addition, the connection part 233 may be formed at the upper ends of the second fixing part 232 and the first fixing part 231. That is, the connection part 233 may connect the upper end of the second fixing part 232 to the upper end of the first fixing part 231. Accordingly, when viewed from the side, the coupling member 230 may have an overall 'C' shape.

On the other hand, the connection part 233 may be formed in the central portions of the second fixing part 232 and the first fixing part 231.

That is, the connection part 233 may connect the central portion of the second fixing part 232 to the central portion of the first fixing part 231. Accordingly, when viewed from the side, the coupling member 230 may have an overall 'H' shape.

The lower groove 235 that is concave upward on the lower side of the connection part 233 and the upper groove 234 that is concave downward on the upper side of the connection part 233 may be formed between the second fixing part 232 and the first fixing part 231.

In addition, the connection part 233 may form intermediate grooves 236 that are concave downward from the upper end.

The intermediate grooves 236 may be spaced apart from each other. The intermediate groove 236 may be disposed in an extension direction of the upper groove 234 or the lower groove 235 (the left-and-right direction in FIG. 6).

The intermediate groove 236 may be formed to extend in the arrangement direction of the second fixing part 232 and the first fixing part 231.

The intermediate groove 236 may have a curved edge.

As a modification, the connection part 233 may form intermediate holes (not shown) opened in the vertical direction.

In this case, the intermediate holes (not shown) may be spaced apart from each other. The intermediate hole (not shown) may be disposed in the extension direction of the upper groove 234 or the lower groove 235 (the left-and-right direction in FIG. 6).

The intermediate hole (not shown) may be formed to extend in the arrangement direction of the second fixing part 232 and the first fixing part 231.

In addition, the second fixing part 232 or the first fixing part 231 may form a contact protrusion 237 protruding inward on the surface facing the inside.

In addition, a plurality of contact protrusions 237 may be spaced apart from each other.

Accordingly, a concave spacing groove 238 may be formed between the contact protrusions 237.

The contact protrusion 237 or the spacing groove 238 may be disposed in the extension direction of the upper groove 234 or the lower groove 235 (the left-and-right direction in FIG. 6).

The contact protrusion 237 or the spacing groove 238 may extend in the vertical direction.

The contact protrusion 237 may have one side 237*a* facing inward as a flat surface.

In addition, the contact protrusion 237 or the spacing groove 238 may have a curved edge.

Referring to FIG. 12, a thickness T2 of the second fixing part 232 may be different from a thickness T1 of the first fixing part 231.

For example, the thickness T2 of the second fixing part 232 may be thicker than the thickness T1 of the first fixing part 231.

Conversely, the thickness T2 of the second fixing part 232 may be thinner than the thickness T1 of the first fixing part 231.

When the contact protrusion 237 is formed on the second fixing part 232, the thickness T2 of the second fixing part 232 means the thickness including the contact protrusion 237.

Hereinafter, the reason why the thickness T2 of the second fixing part 232 is different from the thickness T1 of the first fixing part 231 as described above will be described.

The front panel 210 may be made of a metal material (e.g., steel) having a low degree of deformation due to an external force.

In addition, the front panel 210 may be made of a glass material or a plastic material.

In addition, the front panel 210 may be made of various materials including wood.

Hereinafter, the 'front panel' will be described in more detail with reference to the drawings.

FIG. 13 is a cross-sectional view showing a state in which a steel front panel is mounted on the refrigerator door according to an embodiment of the present disclosure. FIG. 14 is a cross-sectional view showing a state in which a front panel made of a glass material is mounted on the refrigerator door according to an embodiment of the present disclosure.

Referring to FIG. 13, when the front panel 210 is made of a steel material, a thickness T3 of the front panel 210 is relatively thin.

Conversely, referring to FIG. 14, when the front panel 210 ' is made of a glass material, a thickness T4 of the front panel 210' is relatively thick.

That is, the thickness T3 of the front panel 210 made of a steel material is thinner than the thickness T4 of the front panel 210' made of a glass material (T3<T4)

At this time, it is necessary to adjust the thickness of the coupling member 230 according to the thicknesses T3 and T4 of the front panels 210 and 210'.

In detail, when the thicknesses T3 and T4 of the front panels 210 and 210' are different, the gap between the inner surfaces of the front panels 210 and 210' and the front surface of the frame assembly 100 (the lower surface of FIG. 13) is different.

First, when the front panel 210 is made of a steel material, the thickness T3 of the front panel 210 is formed to be relatively thin, and a gap G1 between the inner surface of the front panel 210 and the front surface of the frame assembly 100 (the lower surface of FIG. 13) is relatively wide.

On the other hand, when the front panel 210' is made of a glass material, the thickness T4 of the front panel 210' is formed to be relatively thick, and a gap G2 between the inner surface of the front panel 210' and the front surface of the frame assembly 100 (the lower surface of FIG. 14) is relatively narrow.

Accordingly, in a state where the front panels 210 and 210' are mounted on the frame assembly 100, the thickness of the second fixing part 232 of the coupling member 230 disposed between the inner surfaces of the front panels 210 and 210' and the front surface of the frame assembly 100 (the lower surface of FIG. 13) needs to be changed.

At this time, a plurality of coupling members 230 having different thicknesses of the second fixing part 232 are provided, and the suitable coupling member 230 may be selected and used according to the thickness or material of the front panels 210 and 210'.

On the other hand, as in the present disclosure, when the second fixing part 232 and the first fixing part 231 of the coupling member 230 have different thicknesses, the direction of the coupling member 230 may be changed according to the thickness or material of the front panels 210 and 210'.

Referring to FIGS. 13 and 14, the second fixing part 232 is formed to be thicker than the first fixing part 231.

First, as shown in FIG. 13, when the front panel 210 is made of a thin steel material, the first fixing part 231 having a relatively small thickness is accommodated in the hollow part 101 of the frame assembly 100 through the coupling hole 102. The second fixing part 232 having a relatively large thickness is fixed to the inner surface of the front panel 210.

On the other hand, as shown in FIG. 14, when the front panel 210 is made of a thick glass material, the second fixing part 232 having a relatively large thickness is accommodated in the hollow part 101 of the frame assembly 100 through the coupling hole 102. The first fixing part 231 having a relatively small thickness is fixed to the inner surface of the front panel 210'.

That is, according to the present disclosure, even if the thicknesses of the front panels 210 and 210' are changed, there is an advantage that can be used by changing the direction of one coupling member 230.

Hereinafter, the 'reinforcing panel' will be described in more detail with reference to the drawings.

FIG. 15 is a front view of the reinforcing panel according to an embodiment of the present disclosure. FIG. 16 is a perspective view of the reinforcing panel according to an embodiment of the present disclosure. FIG. 17 is a perspective view showing a state in which the reinforcing panel is cut in a transverse direction according to an embodiment of the present disclosure. FIG. 18 is a cross-sectional view of the reinforcing panel according to an embodiment of the present disclosure.

Referring to FIGS. 15 to 18, the reinforcing panel 240 may be disposed between the front panel 210 and the rear panel 220.

The reinforcing panel 240 may be made of a metal material such as steel or aluminum.

In addition, at least a portion of the reinforcing panel 240 may be formed in a flat surface.

In addition, the reinforcing panel 240 may have irregularities formed on the surface thereof.

In addition, the reinforcing panel 240 may be provided in a form in which at least a portion thereof is perforated to define a plurality of holes.

The reinforcing panel 240 is disposed between the front panel 210 and the rear panel 220 and reinforces the panel assembly 200 to prevent warpage of the panel assembly 200 and to maintain the panel assembly 200 in a flat state.

For example, the reinforcing panel 240 may be provided with a corrugated steel sheet having irregularities formed in the horizontal direction (the left-and-right direction in FIG. 18).

In addition, the reinforcing panel 240 has a form in which a ridge 241 and a valley 242 are repeatedly formed in the horizontal direction (the left-and-right direction in FIG. 18).

In addition, the valley 242 may be formed in the direction of the front panel 210. At least a portion of the valley 242 may be formed in a plane.

For example, the front surface of the reinforcing panel 240 (the lower surface of FIG. 5) may be in contact with the rear surface of the front panel 210 (the upper surface of FIG. 5). At this time, the valley 242 of the reinforcing panel 240 is in contact with the rear surface of the front panel 210.

As described above, when the valley 242 of the reinforcing panel 240 is formed to be flat, the contact area between the reinforcing panel 240 and the front panel 210 may be increased.

In addition, flat portions 243 in which irregularities, wrinkles, holes, etc. are not formed may be formed on the upper and lower ends and left and right ends of the reinforcing panel 240.

In addition, a magnet (not shown) may be attached to at least a portion of the reinforcing panel 240 in order to improve warpage.

For example, a magnet (not shown) may be attached to at least a portion of the flat portion 243 in order to improve warpage of the reinforcing panel 240.

In addition, a magnet (not shown) may be attached to at least a portion of the front panel 210 in order to improve warpage.

In addition, the heat insulating layer (see 250 of FIG. 5) may be formed between the front panel 210 and the rear panel 220.

For example, the heat insulating layer (see 250 of FIG. 5) may be formed by foaming urethane between the front panel 210 and the rear panel 220.

As another example, the heat insulating layer (see 250 of FIG. 5) may be formed by foaming urethane between the reinforcing panel 240 and the rear panel 220.

In addition, a heat insulating pad (not shown) made of a heat insulating material may be additionally disposed at a central portion or a peripheral portion between the front panel 210 and the rear panel 220.

In addition, a heat insulating pad (not shown) made of a heat insulating material may be additionally disposed at a central portion or a peripheral portion between the reinforcing panel 240 and the panel 240 or between the reinforcing panel 240 and the front panel 210.

Hereinafter, the 'frame assembly' will be described in more detail with reference to the drawings.

FIG. 19 is a front view of an outer frame according to an embodiment of the present disclosure. FIG. 20 is a perspective view of the outer frame according to an embodiment of the present disclosure. FIG. 21 is an enlarged perspective view of a portion of FIG. 20. FIG. 22 is a cross-sectional view taken along line C-C of FIG. 21. FIG. 23 is a perspective view of an inner frame according to an embodiment of the present disclosure. FIG. 24 is a cross-sectional view taken along line D-D of FIG. 23.

For reference, since the frame assembly 100 is disposed on both sides of the refrigerator door 20, the frame assembly 100 may be understood as a side frame. In addition, since the frame assembly 100 is vertically disposed on both sides of the refrigerator door 20, the frame assembly 100 may be understood as a vertical frame.

Referring to FIGS. 19 to 24, the frame assembly 100 may include a first plane 111 formed to face the front panel 210 and a second plane 112 formed on one side of the first plane 111 and extending in a direction perpendicular to the first plane 111, and the first plane 111 may include an outer frame 110 in which the coupling hole 102 is formed. The outer frame 110 is disposed in a line on both sides.

In addition, the frame assembly 100 may include a third plane 121 facing the first plane 111, a fourth plane 122 extending in the vertical direction from one side of the third plane 121, and an inner frame 120 disposed at the rear of the outer frame 110 to form the hollow portion 101 together with the outer frame 110. The inner frame 120 is also disposed in a line on both sides.

Here, at least a portion of the fourth plane 122 may be in surface contact with the second plane 112.

In addition, the outer frame 110 and/or the inner frame 120 may be provided in the form of an extruded bar.

The frame assembly 100 configured as described above is located at the outermost portion of the refrigerator door, thereby solving the problem of lifting the refrigerator door.

A groove portion 113 concavely formed to the rear on the other side is formed on the first plane 111, the extension portion (see 244 of FIG. 6) bent backward is formed at one end of the reinforcing panel 240 disposed between the front panel 210 and the rear panel 220, and the extension portion (see 244 of FIG. 6) is inserted into the groove portion 113.

Here, the coupling hole 102 is preferably formed between the groove portion 113 and the second plane 112.

In addition, the inner frame 120 may further include a contact portion 123 extending in the horizontal direction so as to make surface contact with the other end (the left end in FIG. 22) of the first plane 111.

In this case, the contact portion 123 may be supported while making surface contact with the second extension portion 116 formed on the other end portion (the left end portion in FIG. 22) of the first plane 111.

The front surface of the inner frame 120 may be divided into the first plane 111 on one side and the second extension part 116 on the other side with respect to the groove portion 113.

In addition, the third plane 121 may be spaced apart from the first plane 111 to form the hollow portion 101.

In detail, the first plane 111 and the third plane 121 are spaced apart in the front-and-rear direction (the vertical direction in FIG. 22) to define the hollow portion 101. That is, the rear surface of the first plane 111 and the front surface of the third plane 121 define the hollow portion 101.

In addition, the inner frame 120 may further include an intermediate portion 124 extending in the front-and-rear direction (the vertical direction in FIG. 23) and connecting the contact portion 123 to the third plane 121.

The contact portion 123 is disposed in front (lower side in FIG. 23) with respect to the third plane 121. The intermediate portion 124 extends in the front-and-rear direction and connects the flat contact portion 123 disposed relatively in the front to the third plane 121 disposed relatively in the rear.

At this time, the intermediate portion 124 may be supported while making surface contact with the side surface 113*a* of the groove portion 113.

In addition, the outer frame 110 may include a seating portion 115 extending in the horizontal direction toward the inside in the second plane 112, and one side of the third plane 121 may be supported in contact with the seating portion 115.

In addition, the outer frame 110 may further include an accommodation portion 114 extending inward from the rear end (the upper portion in FIG. 22) of the second plane 112 in the horizontal direction and then extending in a vertical direction toward the tip.

An accommodation groove 114*a* may be defined by the accommodation portion 114 and the second plane 112.

The rear end (the upper portion in FIG. 24) of the fourth plane 122 of the inner frame 120 may be accommodated in the accommodation groove 114*a*.

In addition, the second plane 112 may further include a side portion 117 that protrudes forward than the first plane 111 at the tip (lower portion of FIG. 22).

In addition, the first plane 111 may form a recessed groove 118 concave backward at one end (the right side in FIG. 22) connected to the second plane 112. In addition, one end of the front panel 210 may be accommodated between the first plane 111 and the second plane 112 by the recessed groove 118.

For example, when the front panel 210 is made of a steel material, the first bent portion (see 211 of FIG. 6) extending while being bent backward and the second bent portion (see 212 of FIG. 6) extending inward from the first bent portion (see 211 of FIG. 6) in the horizontal direction may be formed at both ends of the front panel 210.

The first bent portion (see 211 of FIG. 6) may be supported while being in contact with the side portion 117. In addition, the second bent portion (see 212 of FIG. 6) may be accommodated in the recessed groove 118.

Therefore, when viewed from the outside, the first bent portion (see 211 of FIG. 6) and the second bent portion (see 212 of FIG. 6), which are the edge portions of the front panel 210, are invisible, and a beautiful appearance can be maintained.

In addition, the inner frame 120 also serves to block injection of a foam liquid or the like toward the outer frame 110 into which the coupling member 230 is fitted.

That is, when the foaming liquid is filled between the reinforcing panel 240 and the rear panel 220 to form the heat insulating layer 250, the inner frame 120 prevents the foaming liquid from flowing into the outer frame 110. The hollow portion 101 may maintain a hollow state.

Hereinafter, the 'lower frame' will be described in more detail with reference to the drawings.

FIG. 25 is a partially cut-away perspective view of the lower side of the refrigerator door according to an embodiment of the present disclosure. FIG. 26 is a perspective view of the lower frame according to an embodiment of the present disclosure.

Referring to FIGS. 25 and 26, the refrigerator door 20 may include the lower frame 400 extending in a horizontal direction at a lower end thereof.

The lower end of the lower frame 400 may be exposed to the outside through the lower side of the front panel 210.

In detail, the lower end of the lower frame 400 forms a first protrusion 410 protruding forward. The first protrusion 410 extends in a horizontal direction.

In addition, in the lower frame 400, a stepped portion 420 is formed at the upper end of the first protrusion 410.

The stepped portion 420 may be seated on the lower end of the front panel 210. Here, a third bent portion 213 bent rearward in a horizontal direction may be formed at the lower end of the front panel 210.

In this case, the third bent portion 213 may be in surface contact with the stepped portion 420, and the front panel 210 may be supported by the lower frame 400.

In addition, the lower frame 400 may have a lower accommodation groove 430 concave to the rear on the upper side of the stepped portion 420. In addition, a lower bent portion 245 bent rearward in a horizontal direction may be formed at the lower end of the reinforcing panel 240.

In this case, the reinforcing panel 240 may be supported by the lower frame 400 while the lower bent portion 245 is in surface contact with the bottom surface of the lower accommodation groove 430.

In addition, the lower frame 400 may have a vertical wall 440 extending in a vertical direction. The vertical wall 440 may support the flat portion 243 of the reinforcing panel 240 while facing the flat portion 243 formed at the lower side of the reinforcing panel 240.

In addition, the lower frame 400 may be in a state where parts such as a wheel or a height adjusting member 450 are coupled to the lower end.

Hereinafter, the cap deco will be described in more detail with reference to the drawings. In addition, the coupling structure of the cap deco and the front panel will be described in more detail.

FIG. 27 is an enlarged perspective view of the upper portion of the refrigerator door according to an embodiment of the present disclosure. FIG. 28 is a partially cut-away perspective view of the upper side of the refrigerator door according to an embodiment of to the present disclosure. FIG. 29 is a rear perspective view of the front panel according to an embodiment of the present disclosure. FIG. 30 is an enlarged perspective view of a portion of FIG. 29. FIG. 31 is a perspective view of the coupling member according to an embodiment of the present disclosure. FIG. 32 is a perspective view of the cap deco according to an embodiment of the present disclosure.

Referring to FIGS. 27 to 32, the refrigerator door 20 may further include a cap deco 300 mounted on the upper end of the refrigerator door 20 and forming the upper surface of the refrigerator door 20.

Here, since the cap deco 300 is mounted on the upper end of the refrigerator door 20, the cap deco 300 may be referred to as an 'upper cap deco'.

The upper cap deco 300 may have coupling grooves 310 that are concave downward from the upper end, and the coupling grooves 310 may be spaced apart from each other in the horizontal direction.

In addition, a plurality of coupling protrusions 261 bent downward to be inserted into the coupling grooves 310 are formed at the upper end of the rear surface of the front panel 210.

For example, the coupling protrusions 261 may be integrally formed on the upper end of the rear surface of the front panel 210.

As another example, the coupling protrusion 261 may be provided as a member separate from the front panel 210, and may be coupled to the upper end of the rear surface of the front panel 210.

As another example, the coupling protrusion 261 may be detachably attached to the upper end of the rear surface of the front panel 210.

In addition, the width of the coupling groove 310 in the left-and-right direction may be equal to or greater than the width of the coupling protrusion 261 in the left-and-right direction, so that the coupling protrusion 261 can be easily inserted into the coupling groove 310.

In addition, a plate-shaped coupling member 260 may be fixed to the upper end of the rear surface of the front panel 210, and the coupling protrusion 261 may be integrally formed with the coupling member 261.

In addition, the coupling protrusion 261 may include a first extension portion 262 extending rearward from the rear surface of the front panel 210 in a horizontal direction, and a second extension portion 263 extending vertically downward from the first extension portion 262.

The first extension portion 262 and the second extension portion 263 may be connected to each other by an arc-shaped curved portion 264.

In addition, the coupling member 260 may have an upper groove 265 that is concave rearward on the front surface facing the front panel 210.

The upper end of the front panel 210 may be accommodated in the upper groove 265. Here, a fourth bent portion 214 bent rearward in a horizontal direction may be formed at the upper end of the front panel 210. The fourth bent portion 214 may be fixed while being fitted into the upper groove 265.

In addition, the upper cap deco 300 may have an upper accommodation groove 320 that is concave rearward on the front surface facing the front panel 210. The upper accommodation groove 320 is formed below the upper groove 265 and is formed behind the upper groove 265.

The upper end of the reinforcing panel 240 may be accommodated in the upper accommodation groove 320. Here, an upper bent portion 246 bent rearward in a horizontal direction may be formed at the upper end of the reinforcing panel 240. The upper bent portion 246 may be fixed while being fitted into the upper accommodation groove 320.

In addition, a support wall 330 extending in a vertical direction may be formed at the lower end of the upper cap deco 300. The vertical wall 330 may support the flat portion 243 of the reinforcing panel 240 while facing the flat portion 243 formed at the upper side of the reinforcing panel 240.

In addition, the coupling groove 310 may include a first groove portion 311 in which the first extension portion 262 is accommodated, and a second groove portion 312 formed deeper than the first groove portion 311 so as to accommodate the second extension portion 263.

That is, based on the upper end of the upper cap deco 300, the first groove portion 311 may be formed to have a depth concave by a first value, and the second groove portion 312 may be formed to have a depth concave by a second value greater than the first value.

In addition, the first groove portion 311 is disposed in front of the second groove portion 312.

The first groove portion 311 and the second groove portion 312 may be formed in a step shape when viewed from the side.

In addition, at least a portion of the second groove portion 312 may be formed to have a curved surface corresponding to the curved portion 264.

As described above, when the coupling protrusion 261 is accommodated in the coupling groove 310, at least a portion of the bottom surfaces of the first extension portion 262 and the first groove portion 311 is in surface contact with each other, and the first extension portion 262 and the first groove portion 311 may be coupled to each other through a separate coupling means 270 passing through the bottom surfaces of the first extension portion 262 and the first groove portion 311 in sequence.

To this end, a coupling port 26 to which the coupling means 270 is coupled may be formed on the bottom surface 311*a* of the first extension portion 262 or the first groove portion 311.

Hereinafter, a process of assembling the refrigerator door configured as described above and a process of attaching or detaching the front panel will be briefly described.

First, the frame assembly 100 is manufactured by connecting the outer frame 110 and the inner frame 120.

Thereafter, the 'ㅁ'-shaped frame in which the top, bottom, left, and right are blocked is manufactured by connecting the cap deco 300 and the lower frame 400 to the upper and lower sides of the frame assembly 100, respectively.

Thereafter, the rear panel 220 and the reinforcing panel 240 are connected to the 'ㅁ'-shaped frame.

Here, the front and rear surfaces are blocked by the rear panel 220 and the reinforcing panel 240, both ends are blocked by the frame assembly 100, and the upper and lower portions are blocked by the cap deco 300 and the lower frame 400.

Thereafter, the foaming liquid is injected inside to form the heat insulating layer 250.

The front panel 210 is attached to the outside of the reinforcing panel 240.

At this time, the coupling hole 102 is formed in the outer frame 110, and the coupling member 230 is attached to the rear surface of the front panel 210.

A user inserts the coupling member 230 into the coupling hole 102 while pushing the front panel 210 from the front to the rear. Thereafter, when the front panel 210 is lowered, the connection portion 233 of the coupling member 230 is in contact with the lower end of the coupling hole 102, and the second fixing part 232 passes through the coupling hole 102 and is accommodated in the hollow portion 101.

The second fixing part 232 is supported in contact with the rear surface of the outer frame 110.

In this state, when the user releases his or her hand from the front panel 210, the coupling member 230 maintains a state of being inserted into the coupling hole 102 and the hollow portion 101 by the weight of the front panel 210, and the front panel 210 maintains a state of being fixed to the frame assembly 100.

In this state, when the user wants to separate the front panel 210 for reasons such as replacement, the user lifts the front panel 210 and raises the coupling member 230. When the front panel 210 is pulled from the rear to the front, the coupling member 230 comes out of the coupling hole 102 and the hollow portion 101, and the front panel 210 may be separated from the frame assembly 100.

The invention claimed is:

1. A refrigerator comprising:

a cabinet having a storage space; and a refrigerator door configured to open and close at least a portion of the cabinet, wherein the refrigerator door comprises:

a frame assembly that is disposed at sides of the refrigerator door and that defines an edge of the refrigerator door, the frame assembly having a hollow portion that extends in a longitudinal direction, a front panel that is coupled to a first side of the frame assembly and that defines a front surface of the refrigerator door, a rear panel that is coupled to a second side of the frame assembly and that defines a rear surface of the refrigerator door, and a coupling member configured to fix the front panel to the frame assembly, wherein the frame assembly has coupling holes that are in fluid communication with the hollow portion and an outside of the frame assembly and that face the front panel, the coupling holes being spaced apart from one another in the longitudinal direction, wherein the coupling member comprises:

a first fixing part configured to pass through one of the coupling holes and to be accommodated in the hollow portion of the frame assembly, a second fixing part fixed to the rear surface of the front panel, and a connection portion that connects the second fixing part to the first fixing part, and wherein the connection portion is disposed at a position spaced downward from upper ends of the second fixing part and the first fixing part.

2. The refrigerator of claim 1, wherein the first fixing part and the second fixing part have a flat surface facing outward.

3. The refrigerator of claim 1, wherein the connection portion is formed at a position spaced upward from lower ends of the second fixing part and the first fixing part.

4. The refrigerator of claim 1, wherein the connection portion forms an intermediate groove that is concave downward from an upper end.

5. The refrigerator of claim 1, wherein the second fixing part or the first fixing part forms a contact protrusion protruding inward from a surface facing inward.

6. The refrigerator of claim 5, wherein the contact protrusion is provided in plurality to be spaced apart from each other.

7. The refrigerator of claim 1, wherein the second fixing part and the first fixing part are formed to have different thicknesses.

8. The refrigerator of claim 1, wherein a height of the connection portion is formed to be lower than heights of the second fixing part and the first fixing part.

9. The refrigerator of claim 5, wherein upper grooves that are concave downward are formed in an upper side of the connection portion between the second fixing part and the first fixing part, and wherein lower grooves that are concave upward are formed in a lower side of the connection portion between the second fixing part and the first fixing part.

10. The refrigerator of claim 9, wherein an interval between the lower grooves is smaller than an interval between the upper grooves.

11. The refrigerator of claim 1, wherein the coupling member is fixed to the rear surface of the front panel by a hot-melt method or an adhesive method.

12. The refrigerator of claim 1, wherein the front panel is made of a metal material including a steel material, a glass material, or a plastic material.

13. The refrigerator of claim 1, wherein a reinforcing panel is disposed between the front panel and the rear panel.

14. The refrigerator of claim 13, wherein the reinforcing panel is provided with a corrugated steel plate having irregularities in a horizontal direction.

15. The refrigerator of claim 1, wherein a heat insulating layer formed by foaming urethane is formed between the front panel and the rear panel.

16. The refrigerator of claim 1, wherein the frame assembly comprises:

an outer frame comprising (i) a first plane that faces the front panel and that defines the coupling holes and (ii) a second plane that is disposed at a first side of the first plane and that extends in a direction perpendicular to the first plane; and an inner frame comprising (i) a third plane facing the first plane and (ii) a fourth plane extending from one side of the third plane in a vertical direction, the inner frame being disposed behind the outer frame and defining the hollow portion between the inner frame and the outer frame.

17. The refrigerator of claim 16, wherein the outer frame defines a groove portion at a second side of the first plane, the groove portion being concave rearward, wherein the refrigerator door comprises a reinforcing panel, the reinforcing panel comprising an extension portion that is bent rearward and that is disposed at one end of the reinforcing panel, the one end of the reinforcing panel being disposed between the front panel and the rear panel, and wherein the extension portion is inserted into the groove portion.

18. The refrigerator of claim 16, wherein the inner frame further comprises a contact portion configured to make surface contact with an end of the first plane, wherein the third plane is spaced apart from the first plane to form the hollow portion, and wherein the inner frame further comprises an intermediate portion extending in a front-and-rear direction and configured to connect the contact portion to the third plane.

19. The refrigerator of claim 16, wherein the second plane forms a seating portion extending inward in a horizontal direction, and wherein one side of the third plane is seated on the seating portion.

20. The refrigerator of claim 16, wherein the second plane comprises an accommodation portion extending inward from a rear end in a horizontal direction and then extending toward a front end in the vertical direction.

21. The refrigerator of claim 16, wherein the second plane further comprises a side portion protruding forward than the first plane.

22. The refrigerator of claim 1, further comprising a cap deco mounted on an upper end or a lower end of the refrigerator door and forming an upper surface or a lower surface of the refrigerator door.

23. The refrigerator of claim 22, wherein the cap deco comprises an upper cap deco mounted on the upper end of the refrigerator door, wherein the upper cap deco defines coupling grooves that are concave downward from an upper end of the upper cap deco, and wherein the coupling grooves are spaced apart from each other in a horizontal direction.

24. The refrigerator of claim 23, wherein a plurality of bent coupling protrusions inserted into the coupling grooves are formed at an upper end of the rear surface of the front panel.

25. The refrigerator of claim 24, wherein a plate-shaped coupling member is fixed to the upper end of the rear surface of the front panel, and wherein the plurality of bent coupling protrusions are formed integrally with the coupling member.

26. The refrigerator of claim 24, wherein the plurality of bent coupling protrusions comprise a first extension portion extending from the rear surface of the front panel in the horizontal direction, and a second extension portion extending vertically downward from the first extension portion.

27. The refrigerator of claim 26, wherein the coupling grooves comprise a first groove portion in which the first extension portion is accommodated, and a second groove portion that is deeper than the first groove portion such that the second extension portion is accommodated therein.

28. The refrigerator of claim 27, wherein, based on the plurality of bent coupling protrusions being accommodated in the coupling grooves, at least portions of bottom surfaces of the first extension portion and the first groove portion are in surface contact with each other, and the first extension portion and the first groove portion are coupled to each other through a separate coupling device passing through the bottom surfaces of the first extension portion and the first groove portion in sequence.

* * * * *